US011329420B2

(12) United States Patent
Aoki et al.

(10) Patent No.: US 11,329,420 B2
(45) Date of Patent: May 10, 2022

(54) CONNECTOR

(71) Applicant: Yazaki Corporation, Tokyo (JP)

(72) Inventors: Eiji Aoki, Shizuoka (JP); Kazuhide Takahashi, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 178 days.

(21) Appl. No.: 16/985,225

(22) Filed: Aug. 5, 2020

(65) Prior Publication Data

US 2021/0044053 A1 Feb. 11, 2021

(30) Foreign Application Priority Data

Aug. 7, 2019 (JP) ..... JP2019-145185

(51) Int. Cl.
*H01R 13/52* (2006.01)
*H01R 13/516* (2006.01)

(52) U.S. Cl.
CPC ..... *H01R 13/5205* (2013.01); *H01R 13/516* (2013.01); *H01R 2201/26* (2013.01)

(58) Field of Classification Search
CPC .. H01R 13/5202; H01R 13/42; H01R 13/502; H01R 13/521; H01R 12/58
See application file for complete search history.

(56) References Cited

U.S. PATENT DOCUMENTS 8,328,572 B2 * 12/2012 Tashiro ..... H01R 13/506 439/271
9,033,734 B2 * 5/2015 Tanaka ..... H01R 13/5845 439/587
9,397,440 B2 * 7/2016 Mori ..... H01R 13/5845
9,484,647 B2 * 11/2016 Ishikawa ..... H01R 9/24
9,524,811 B2 * 12/2016 Adachi ..... B60R 16/0215
9,966,715 B2 * 5/2018 Ishibashi ..... H01R 13/512
11,063,387 B2 * 7/2021 Aoki ..... H01R 13/748
2013/0140055 A1 * 6/2013 Adachi ..... B60R 16/0215 174/113 R (Continued)

FOREIGN PATENT DOCUMENTS

EP 2 546 935 A2 1/2013
JP 2006-31962 A 2/2006

(Continued)

*Primary Examiner* — Abdullah A Riyami
*Assistant Examiner* — Nader J Alhawamdeh
(74) *Attorney, Agent, or Firm* — Kenealy Vaidya LLP

(57) ABSTRACT

A connector includes an insulating housing, a conductor unit having a plurality of conductors arranged in a row and an insulating holding body integrally molded with the conductors, and a sealing member that seals between the conductor unit and the housing. Each of the conductors includes a plate-shaped body and terminal parts provided at both ends of the body, respectively. The holding body includes a fitting part fitted to the housing, a plurality of covering parts each extending from the fitting part along the body and individually surrounding the body, and insulating walls each dividing two adjacent terminal parts. Each of the insulating walls has a main wall part and the main wall part extends on an extension line of a gap between two adjacent covering parts and divides two adjacent terminal parts.

6 Claims, 24 Drawing Sheets

(56) References Cited

U.S. PATENT DOCUMENTS

| | | | | |
|---|---|---|---|---|
| 2014/0322973 | A1* | 10/2014 | Okamoto | H01R 13/4223 439/587 |
| 2015/0118905 | A1* | 4/2015 | Mori | H01R 13/504 439/606 |
| 2015/0214655 | A1* | 7/2015 | Mori | H01R 13/504 439/606 |
| 2016/0172784 | A1* | 6/2016 | Kataoka | H01R 13/5202 439/271 |
| 2018/0358748 | A1* | 12/2018 | Yamanashi | H01R 13/6315 |
| 2019/0379154 | A1* | 12/2019 | Nishijima | H01R 13/512 |
| 2021/0036458 | A1* | 2/2021 | Aoki | H01R 13/42 |
| 2021/0044052 | A1* | 2/2021 | Takahashi | H01R 13/748 |
| 2021/0044053 | A1* | 2/2021 | Aoki | H01R 13/502 |
| 2021/0091507 | A1* | 3/2021 | Aoki | H01R 13/521 |

FOREIGN PATENT DOCUMENTS

| | | | |
|---|---|---|---|
| JP | 2018-116896 | A | 7/2018 |
| JP | 2019-71271 | A | 5/2019 |

* cited by examiner

CONNECTOR

CROSS-REFERENCE TO RELATED APPLICATION(S)

The present application claims priority to and incorporates by reference the entire contents of Japanese Patent Application No. 2019-145185 filed in Japan on Aug. 7, 2019.

BACKGROUND OF THE INVENTION

1. Field of the Invention

The present invention relates to a connector.

2. Description of the Related Art

In the related art, there is a connector having a plurality of conductors. Japanese Patent Application Laid-open No. 2018-116896 discloses a device connector including a main housing retaining a bus bar for relaying a power circuit, an electric wire with a connector including an electric wire for relaying a signal circuit and a sub-connector connected to a terminal of the electric wire, and an electric wire retention part connecting with the main housing and retaining the electric wires.

The applicant is considering of integrally molding an insulating holding body with a plurality of conductors to form a conductor unit. Here, in order to secure an insulation distance between adjacent conductors and reduce the number of parts, it is effective to provide the holding body with a covering part that covers the conductor and an insulating wall that divides terminal parts of adjacent conductors. On the other hand, when the insulating wall is provided, the size of the holding body increases, which may lead to an increase in the size of a connector.

SUMMARY OF THE INVENTION

An object of the present invention is to provide a connector capable of suppressing an increase in size while securing an insulation distance between adjacent conductors.

In order to solve the above mentioned problem and achieve the object, a connector according to one aspect of the present invention includes an insulating housing that is fixed to a casing of a first device at a communication part through which an opening of the casino; of the first device and an opening of a casing of a second device communicate with each other; a conductor unit including a plurality of conductors arranged in a row and an insulating holding body integrally molded with the conductors; and a sealing member that seals between the conductor unit and the housing, wherein each of the conductors includes a plate-shaped body and terminal parts provided at both ends of the body, respectively, the holding body includes a fitting part fitted to the housing, a plurality of covering parts each extending from the fitting part along the body and individually surrounding the body, and insulating walls each extending from the covering part and dividing the two adjacent terminal parts, and each of the insulating walls has a main wall part and the main wall part extends on an extension line of a gap between the two adjacent covering parts and divides the two adjacent terminal parts.

According to another aspect of the present invention, in the connector, it is preferable that the insulating wall includes a base that projects from one of the two adjacent covering parts toward the other covering part, and the main wall part extends from a tip end of the base along an extension direction of the covering part.

According to still another aspect of the present invention, in the connector, it is preferable that the base is connected to a tip end surface of the covering part.

According to still another aspect of the present invention, in the connector, it is preferable that the terminal parts of the conductor include a first terminal part, that protrudes from the fitting part and a second terminal part that protrudes from the covering part, a width of the second terminal part is larger than a width of the body, and the main wall part is located in a middle between the two adjacent second terminal parts in an arrangement direction of the conductors.

The above and other objects, features, advantages and technical and industrial significance of this invention will be better understood by reading the following detailed description of presently preferred embodiments of the invention, when considered is connection with the accompanying drawings.

DETAILED DESCRIPTION OF THE PREFERRED EMBODIMENTS

Embodiment

Figure 1:
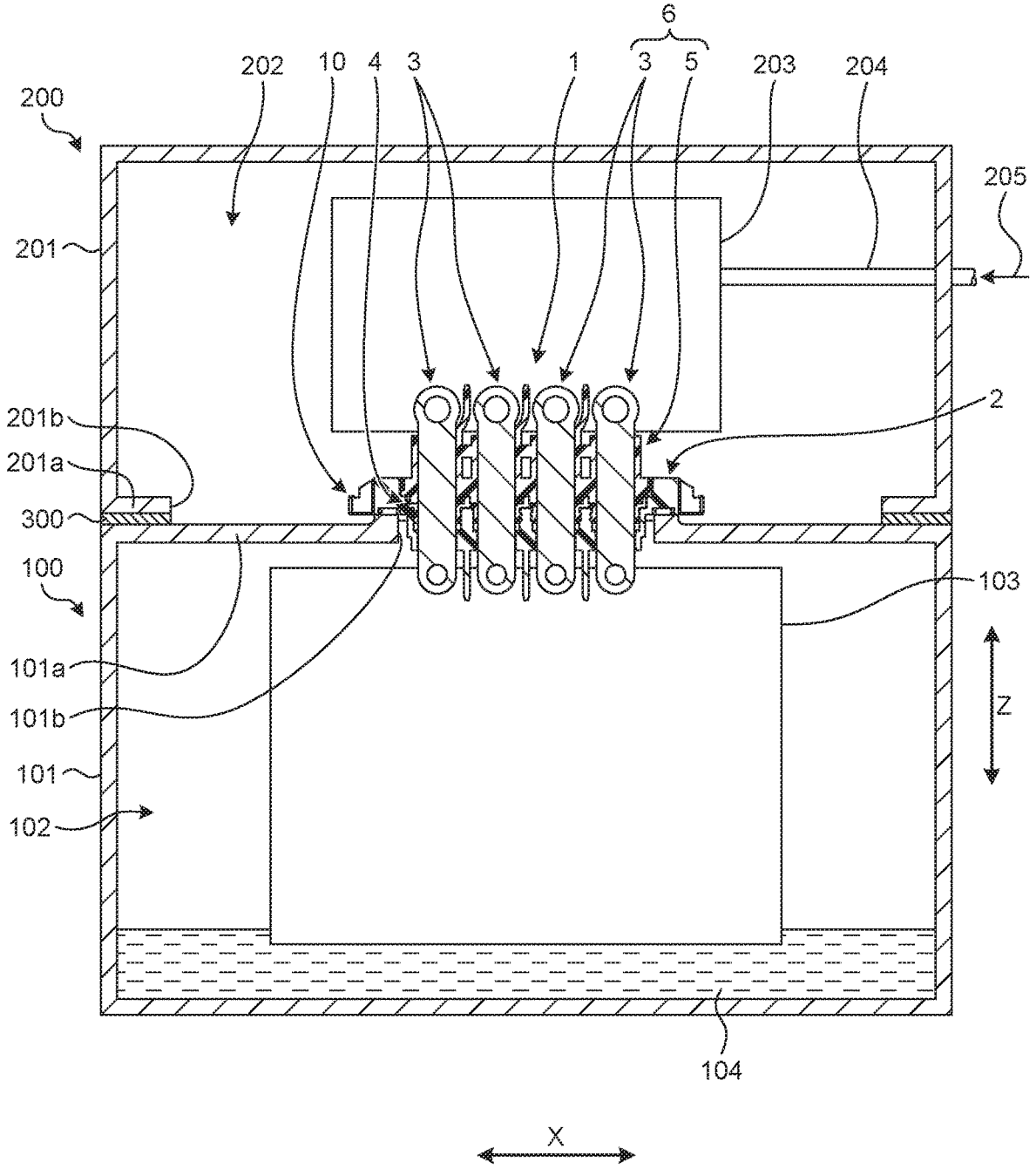
FIG. 1 is a sectional view of a connector, a first device, and a second device according to an embodiment.
Figure 3:
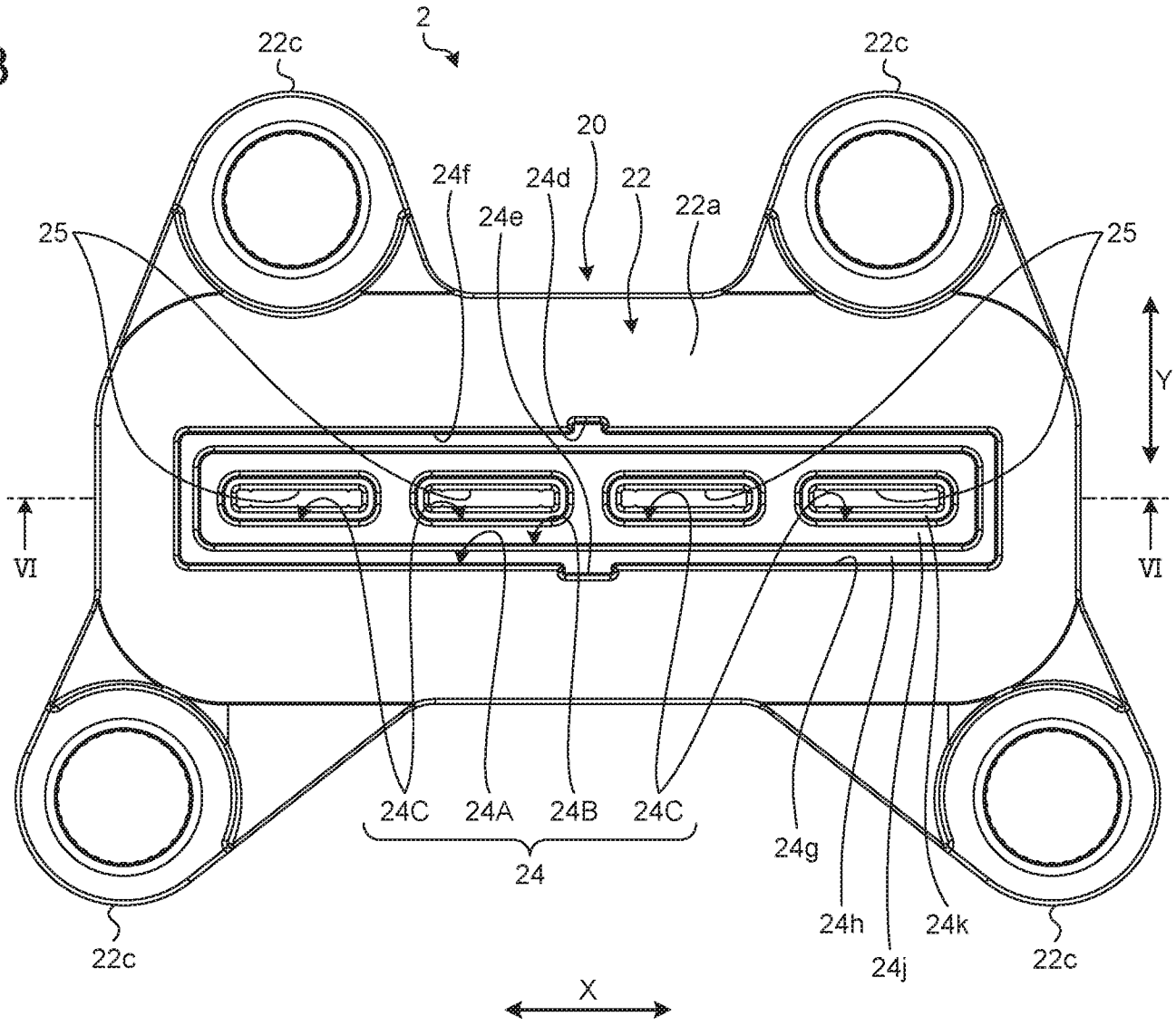
FIG. 3 is a plan view of a housing according to the embodiment.
Figure 4:
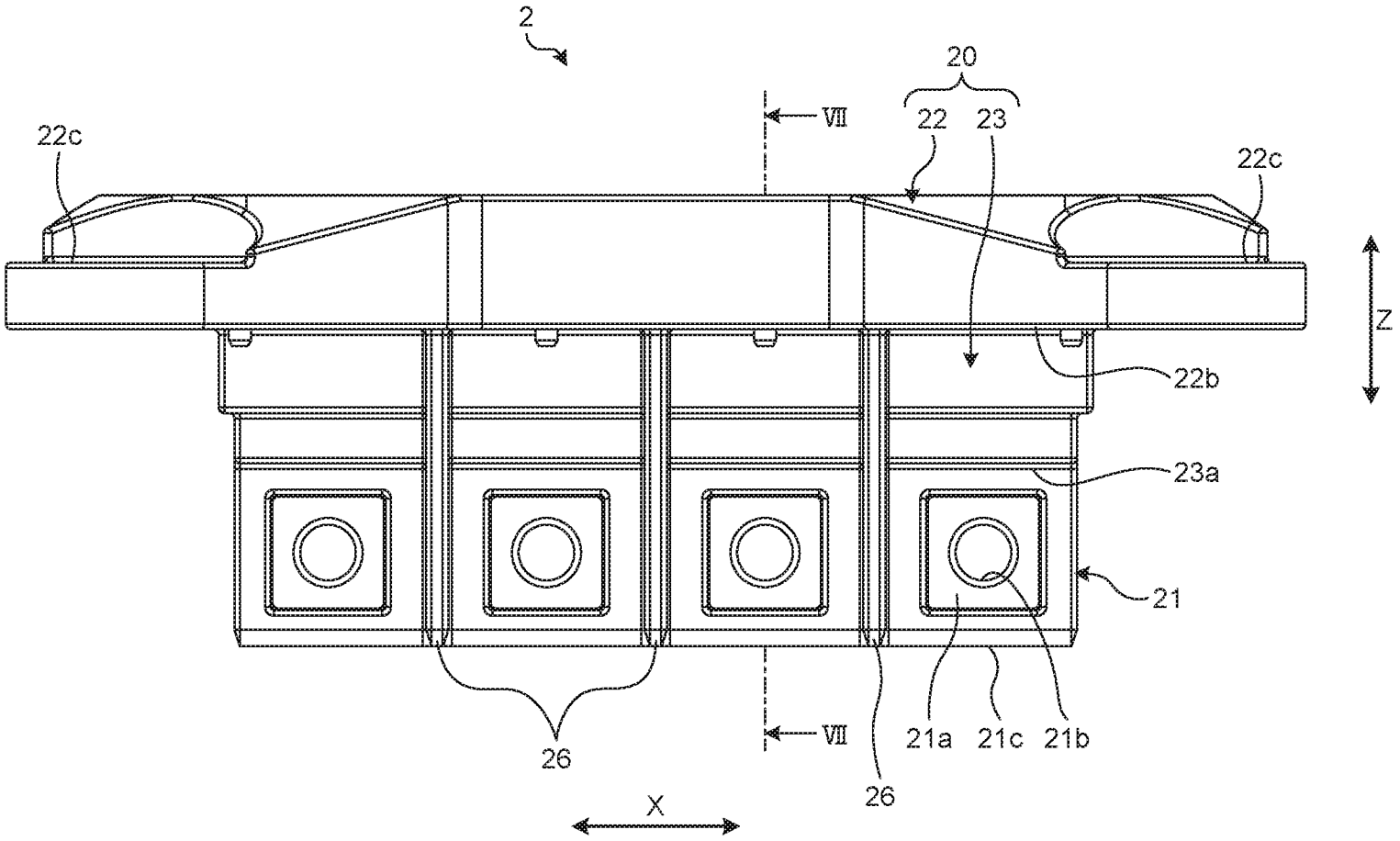
FIG. 4 is a front view of the housing according to the embodiment.
Figure 5:
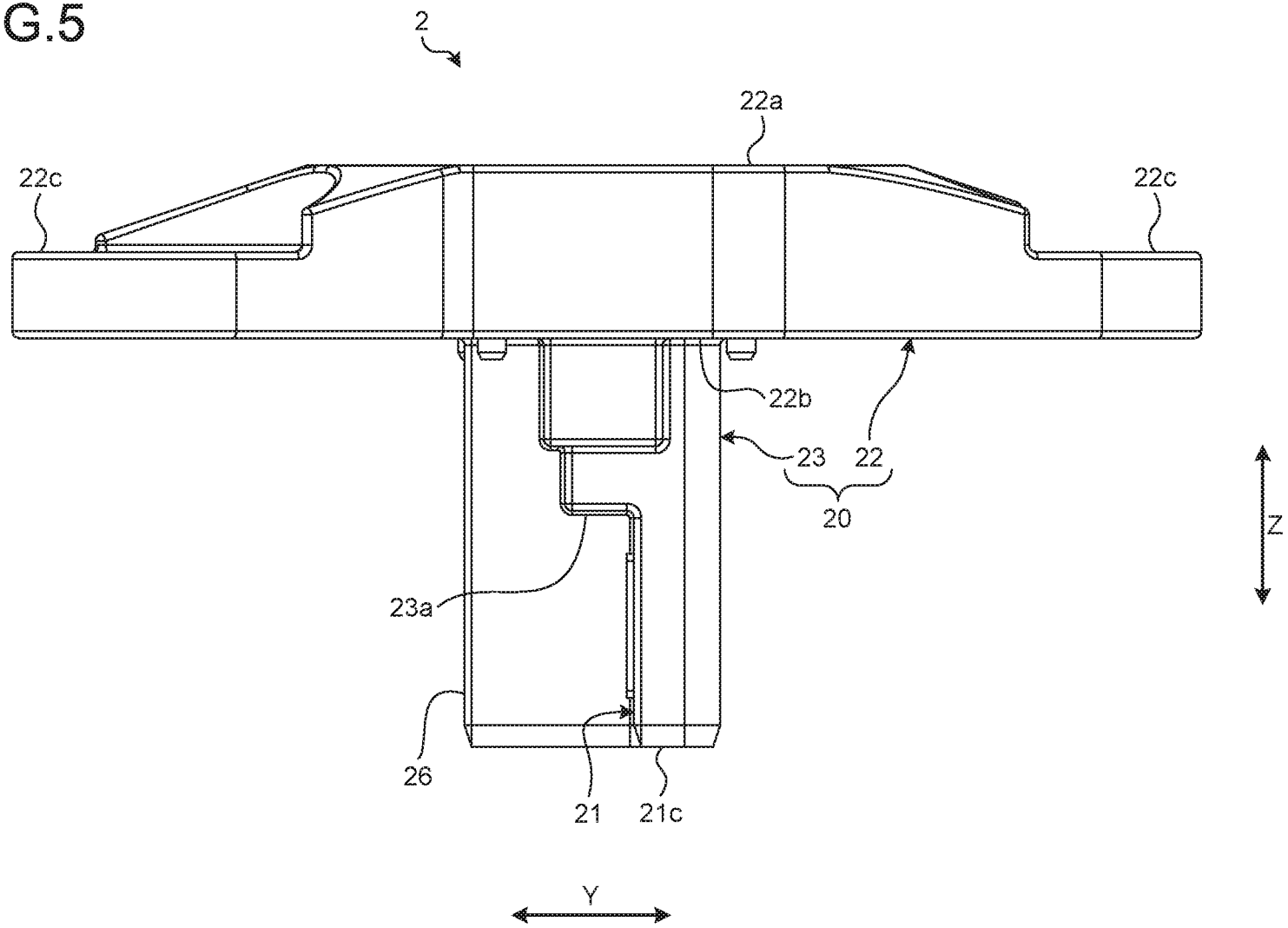
FIG. 5 is a side view of the housing according to the embodiment.
Figure 6:
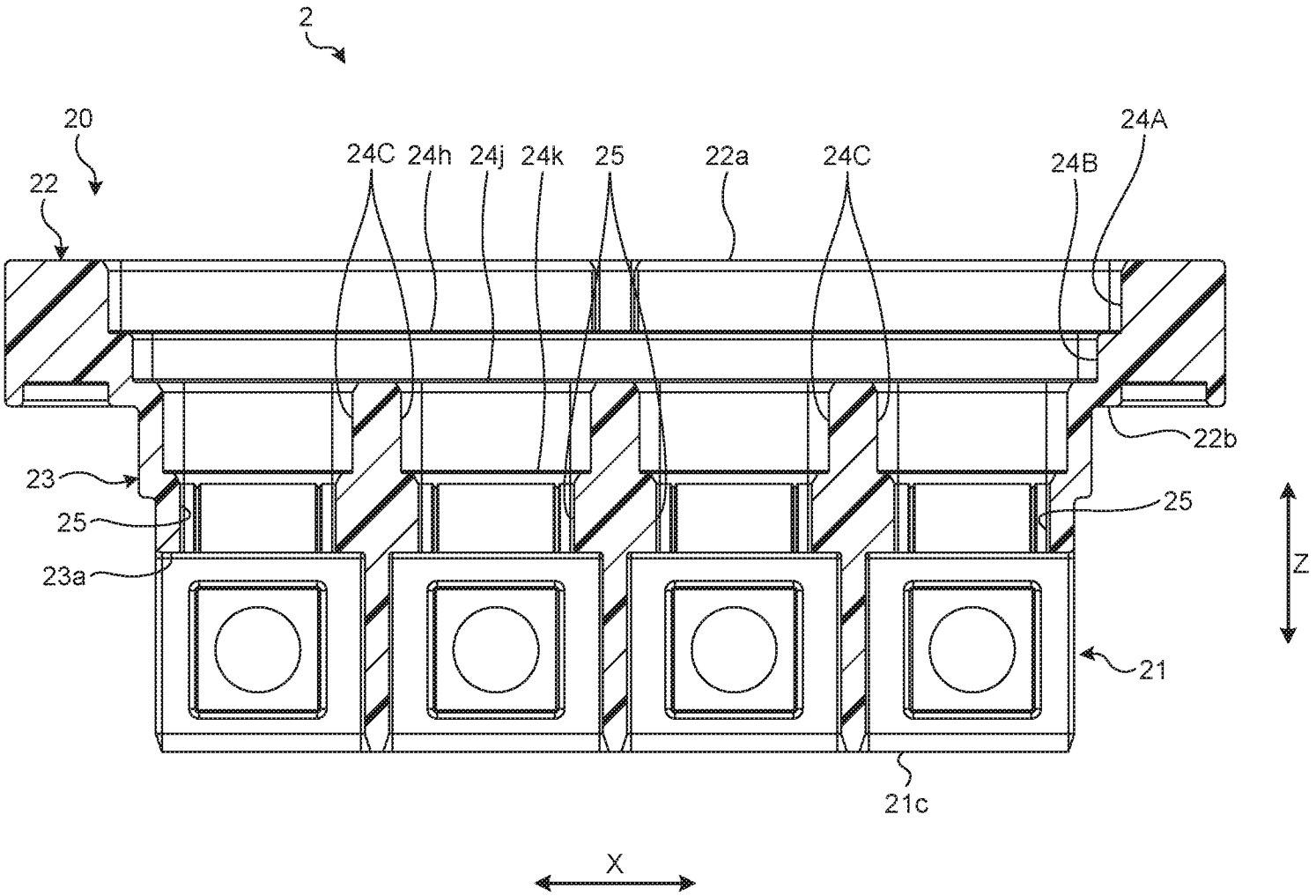
FIG. 6 is a sectional view of the housing according to the embodiment.
Figure 7:
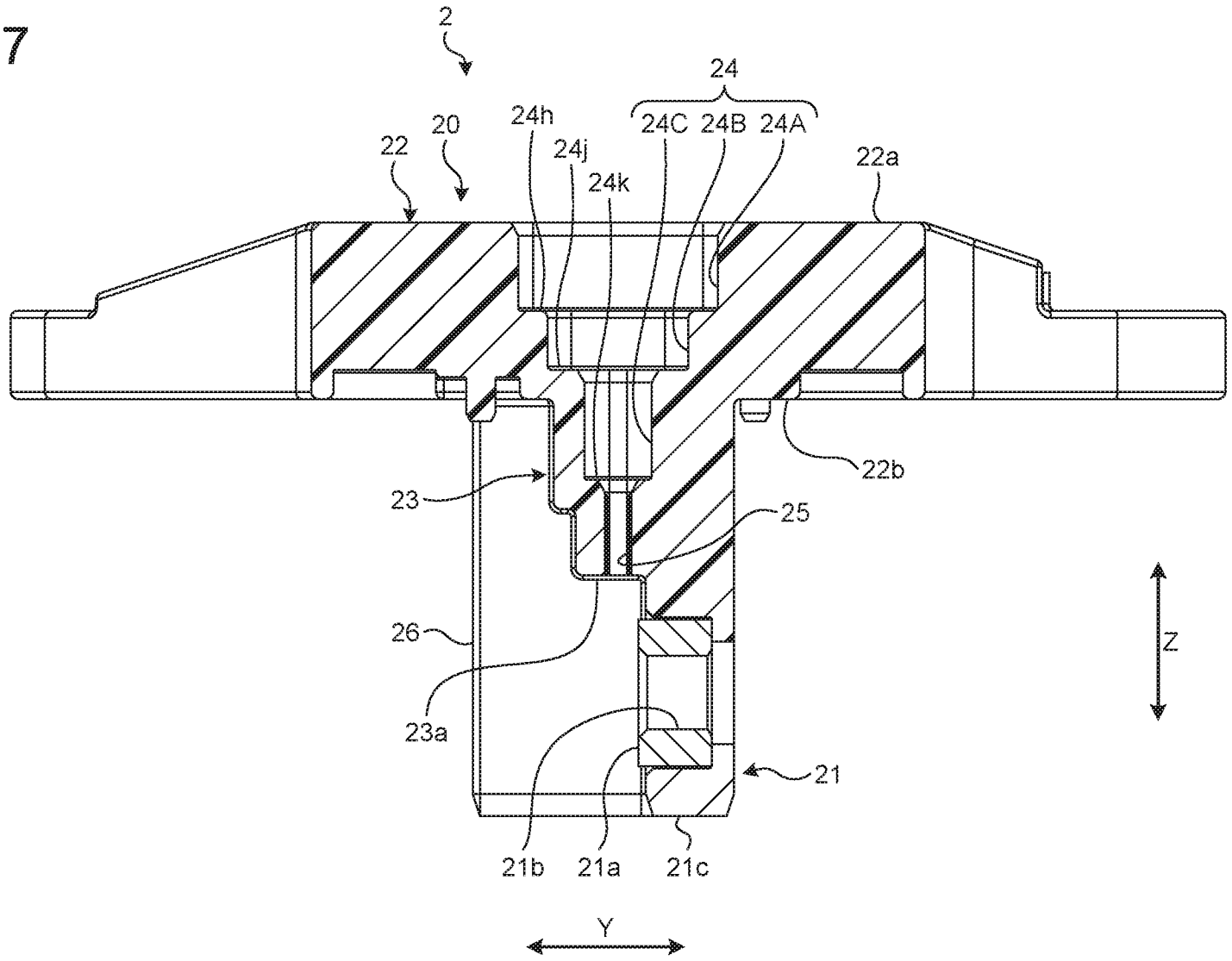
FIG. 7 is another sectional view of the housing according to the embodiment.
Figure 8:
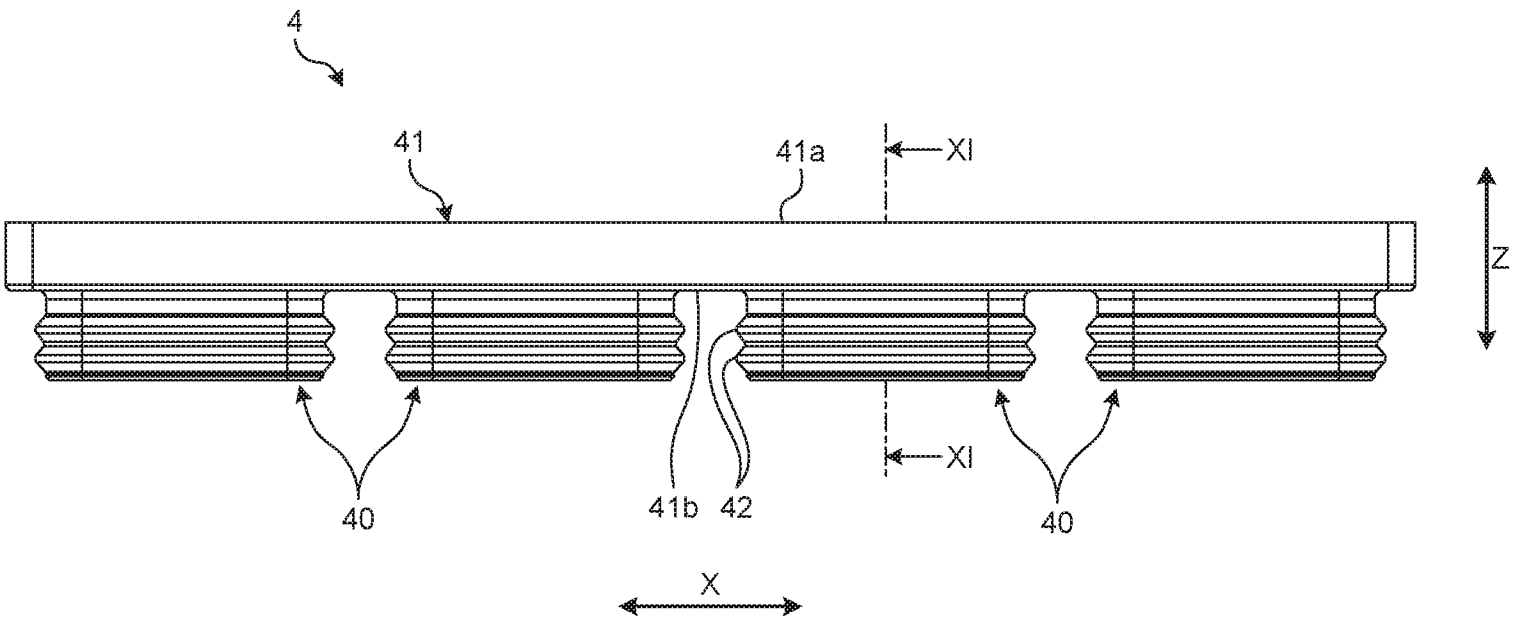
FIG. 8 is a front view of a sealing member according to the embodiment.
Figure 9:
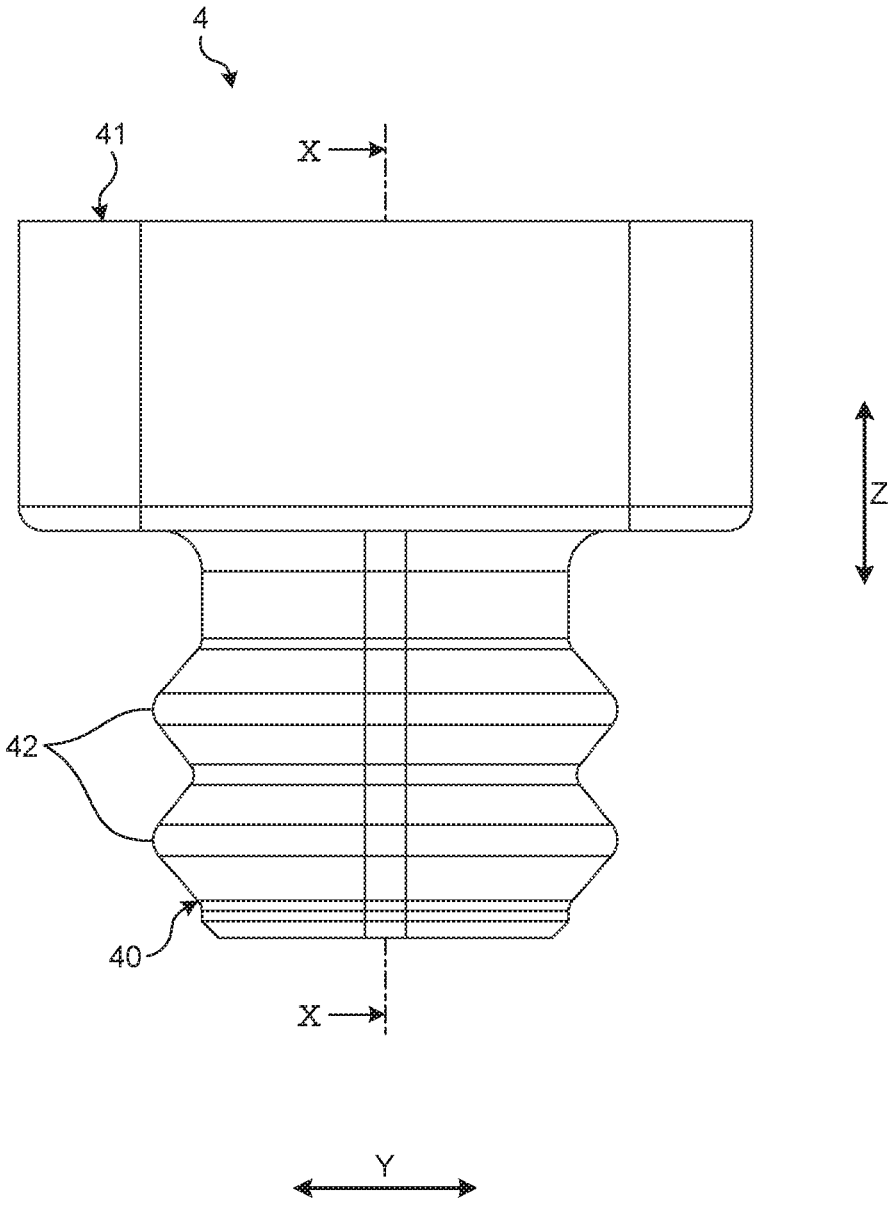
FIG. 9 is a side view of the sealing member according to the embodiment.
Figure 10:
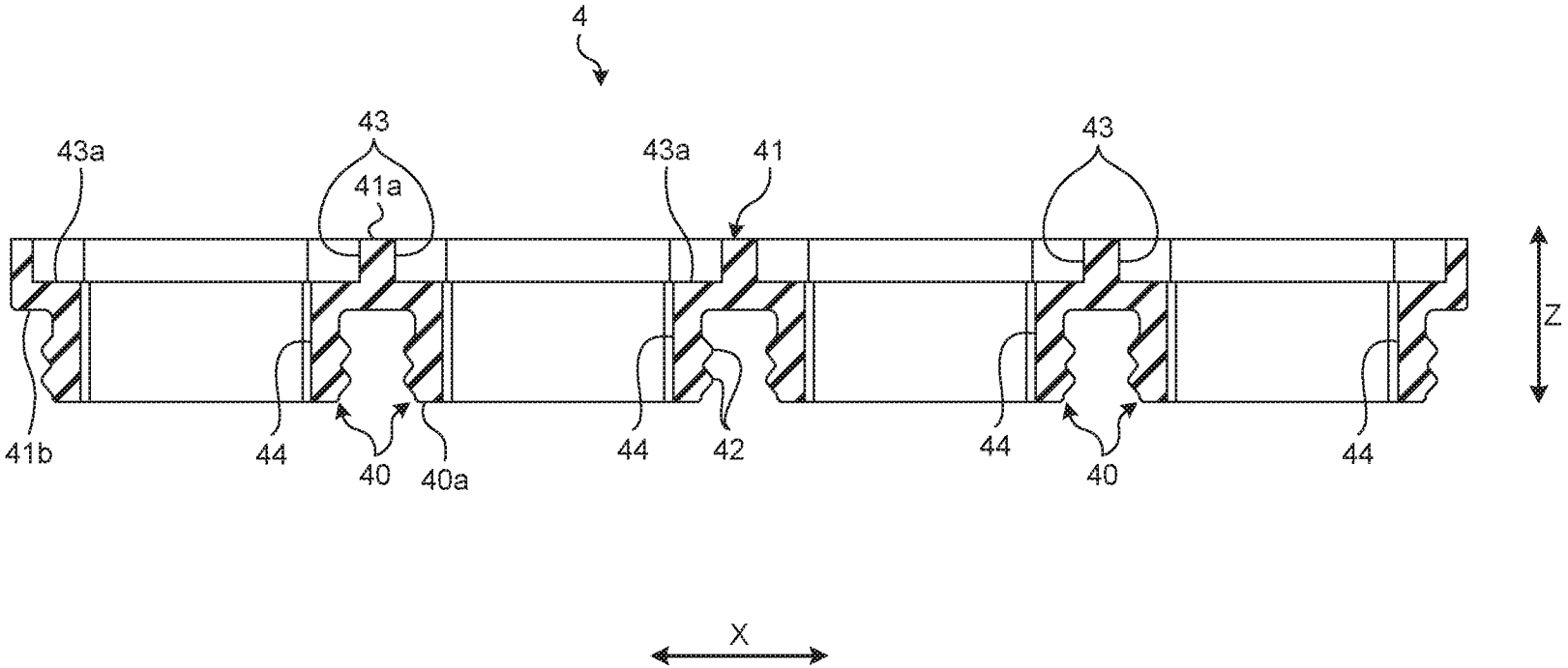
FIG. 10 is a sectional view of the sealing member according to the embodiment.
Figure 11:
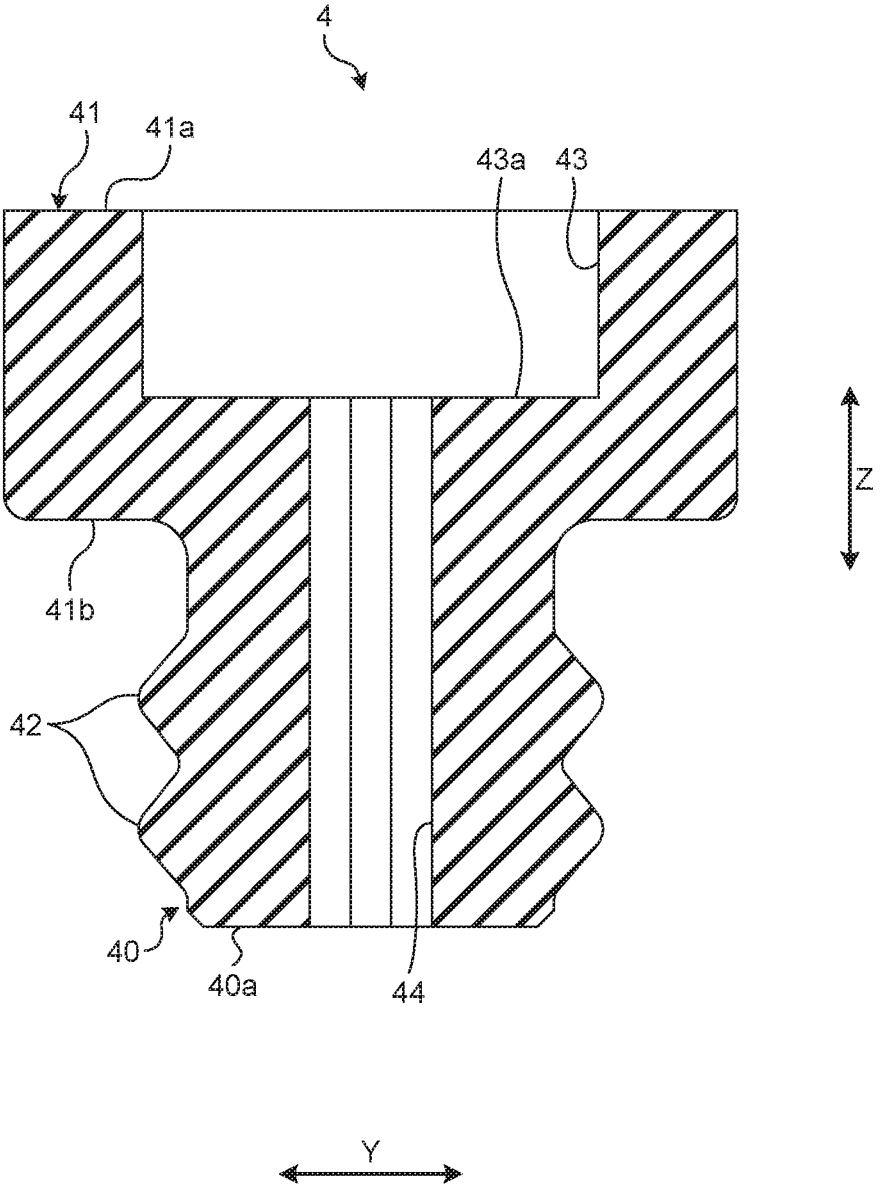
FIG. 11 is another sectional view of the sealing member according to the embodiment.

With reference to FIG. 1 to FIG. 23, an embodiment will be described. The present embodiment relates to a connector. FIG. 1 is a sectional view of a connector, a first device, and a second device according to the embodiment, FIG. 2 is an exploded perspective view of the connector according to the embodiment, FIG. 3 is a plan view of a housing according to the embodiment, FIG. 4 is a front view of the housing according to the embodiment, FIG. 5 is a side view of the housing according to the embodiment, FIG. 6 is a sectional view of the housing according to the embodiment, FIG. 7 is another sectional view of the housing according to the embodiment, FIG. 8 is a front view of a sealing member according to the embodiment, FIG. 9 is a side view of the sealing member according to the embodiment, FIG. 10 is a sectional view of the sealing member according to the embodiment, and FIG. 11 is another sectional view of the sealing member according to the embodiment.

Figure 12:
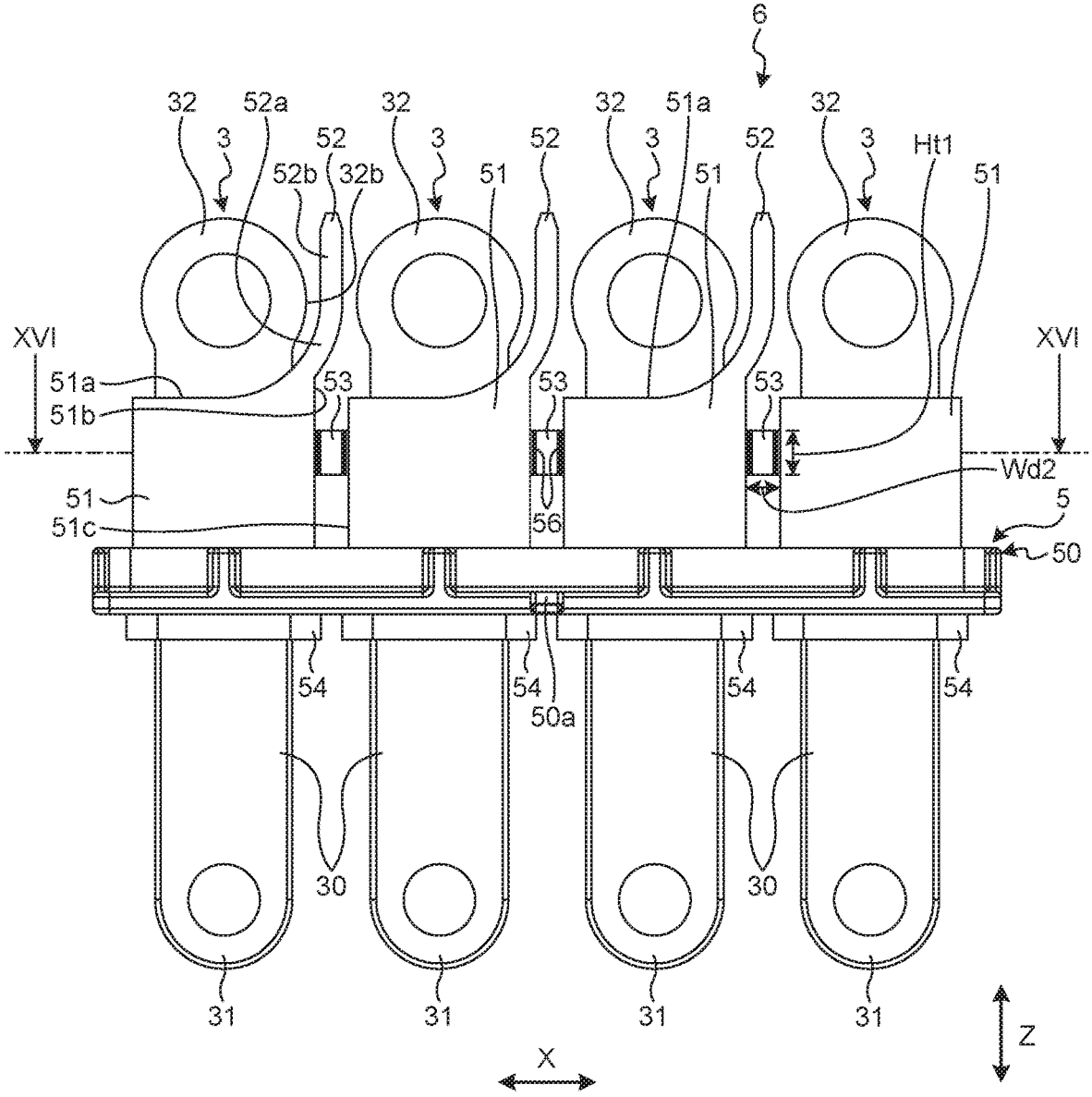
FIG. 12 is a front view of a conductor unit according to the embodiment.
Figure 13:
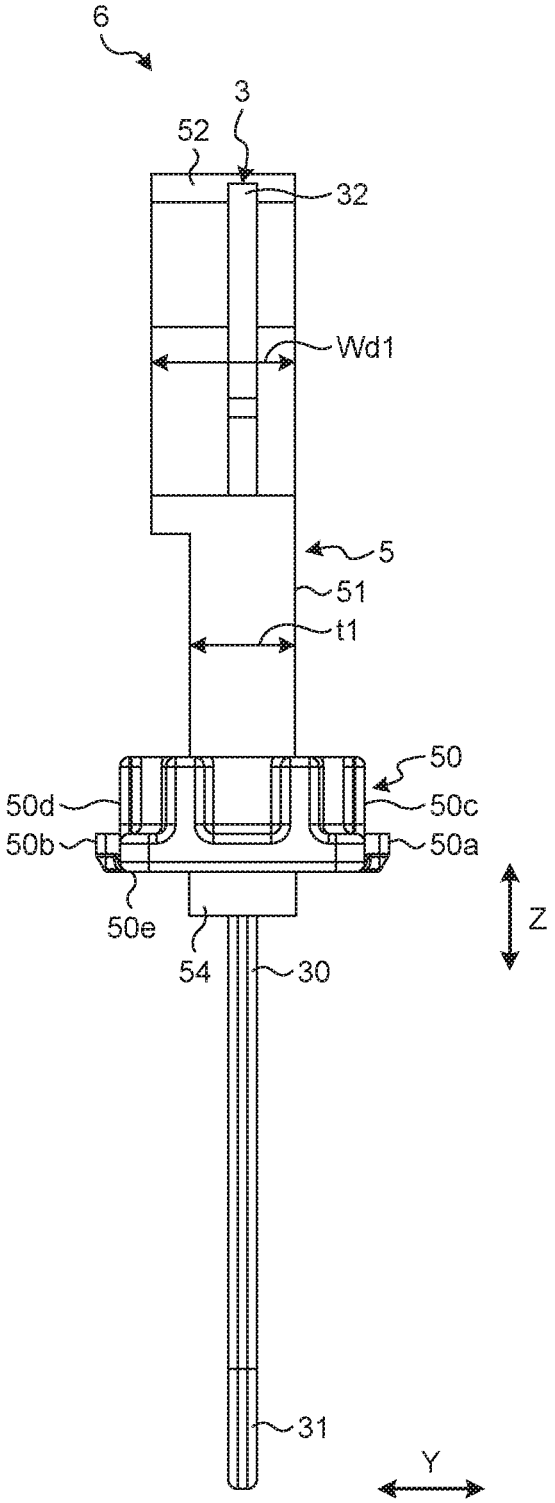
FIG. 13 is a side view of the conductor unit according to the embodiment.
Figure 14:
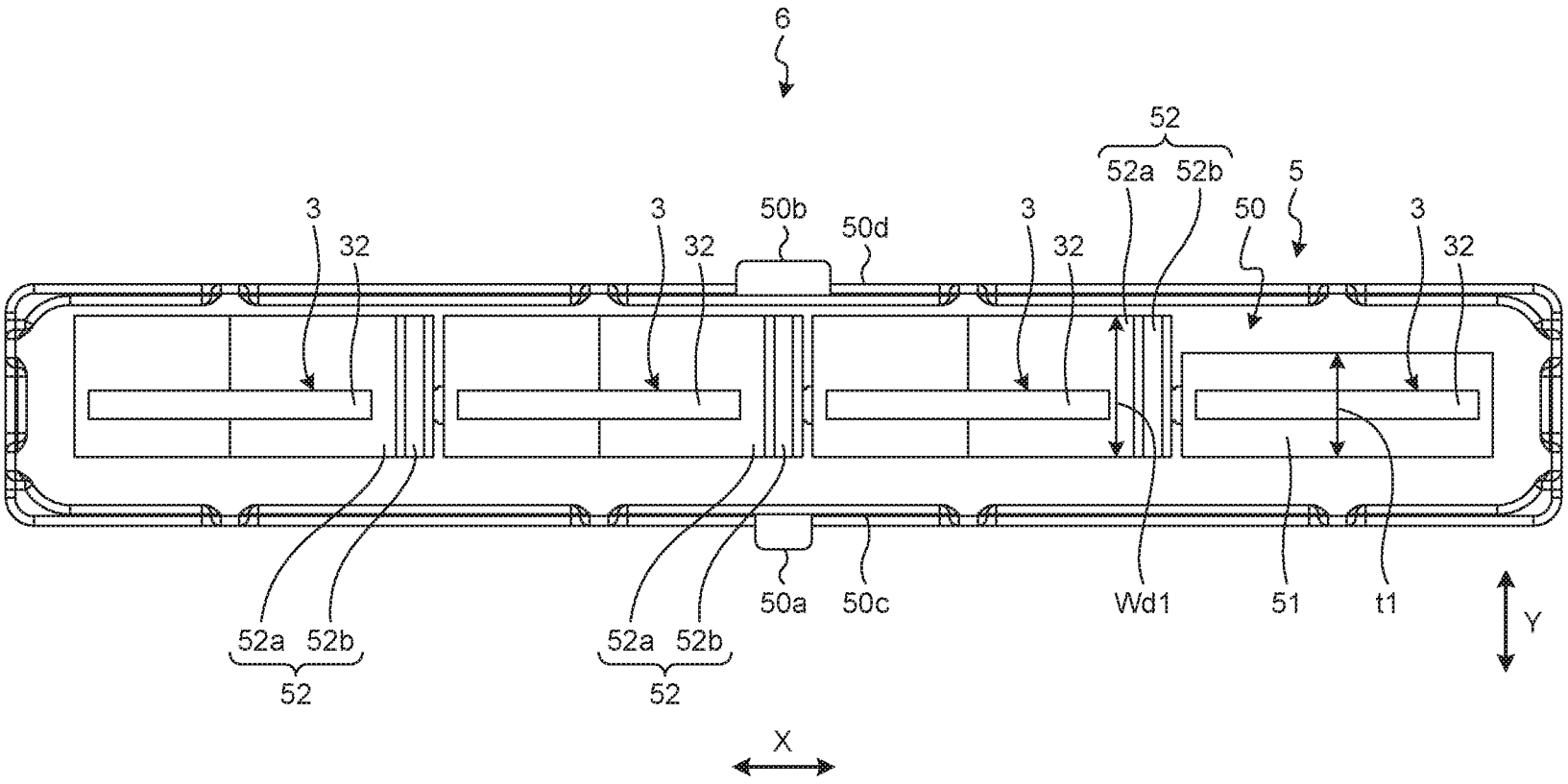
FIG. 14 is a top view of the conductor unit according to the embodiment.
Figure 15:
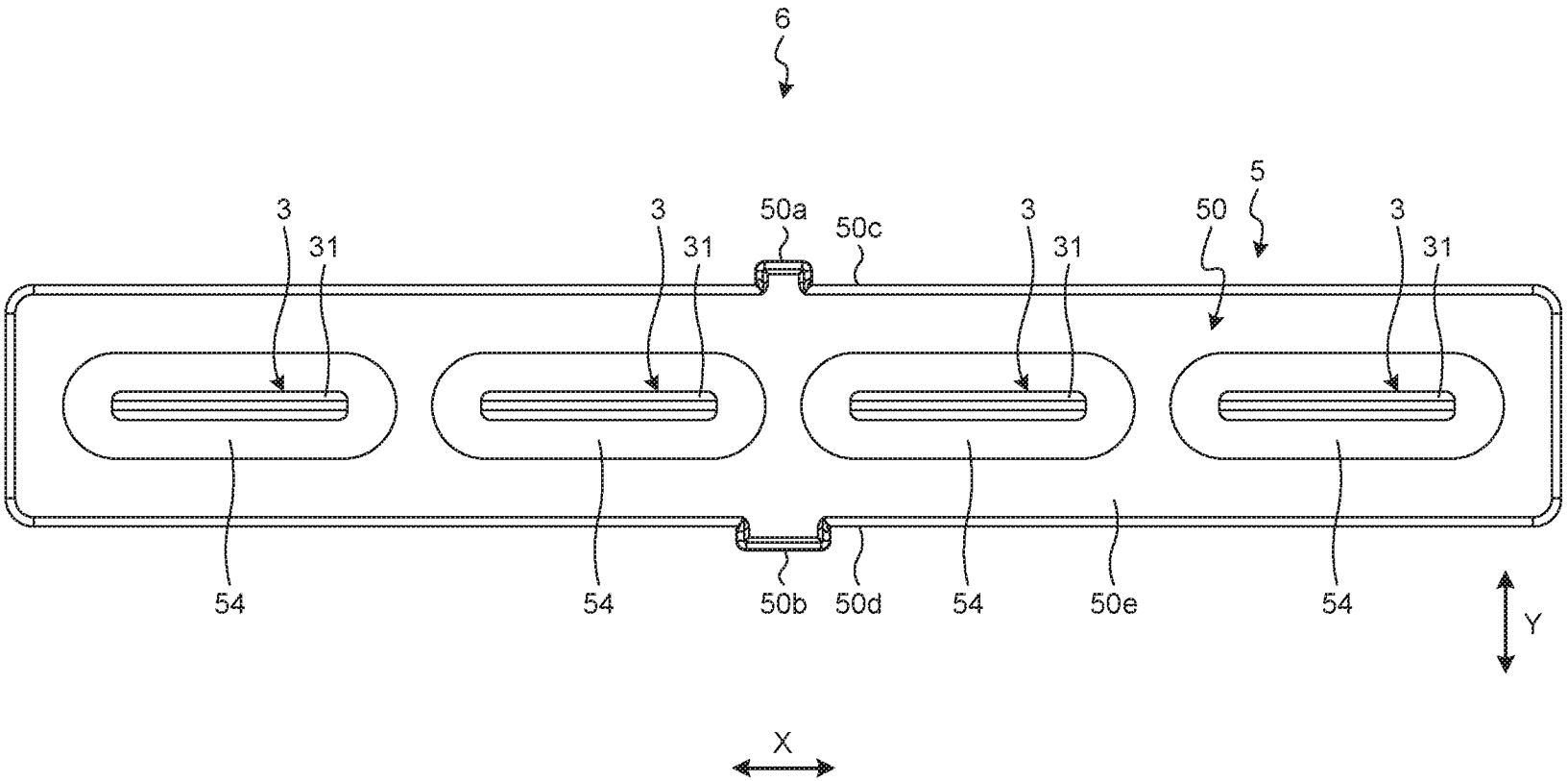
FIG. 15 is a bottom view of the conductor unit according to the embodiment.
Figure 16:
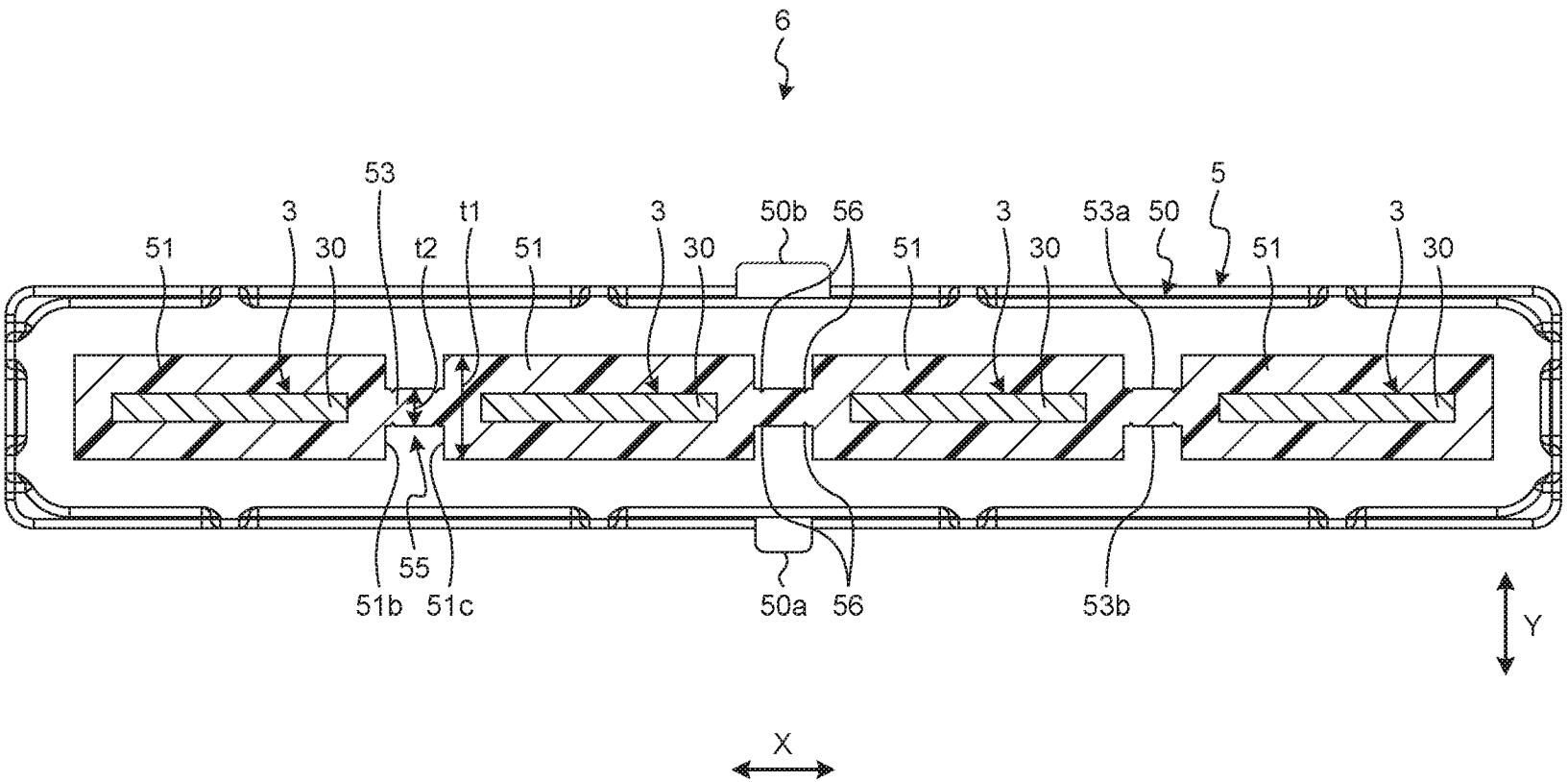
FIG. 16 is a sectional view of the conductor unit according to the embodiment.
Figure 17:
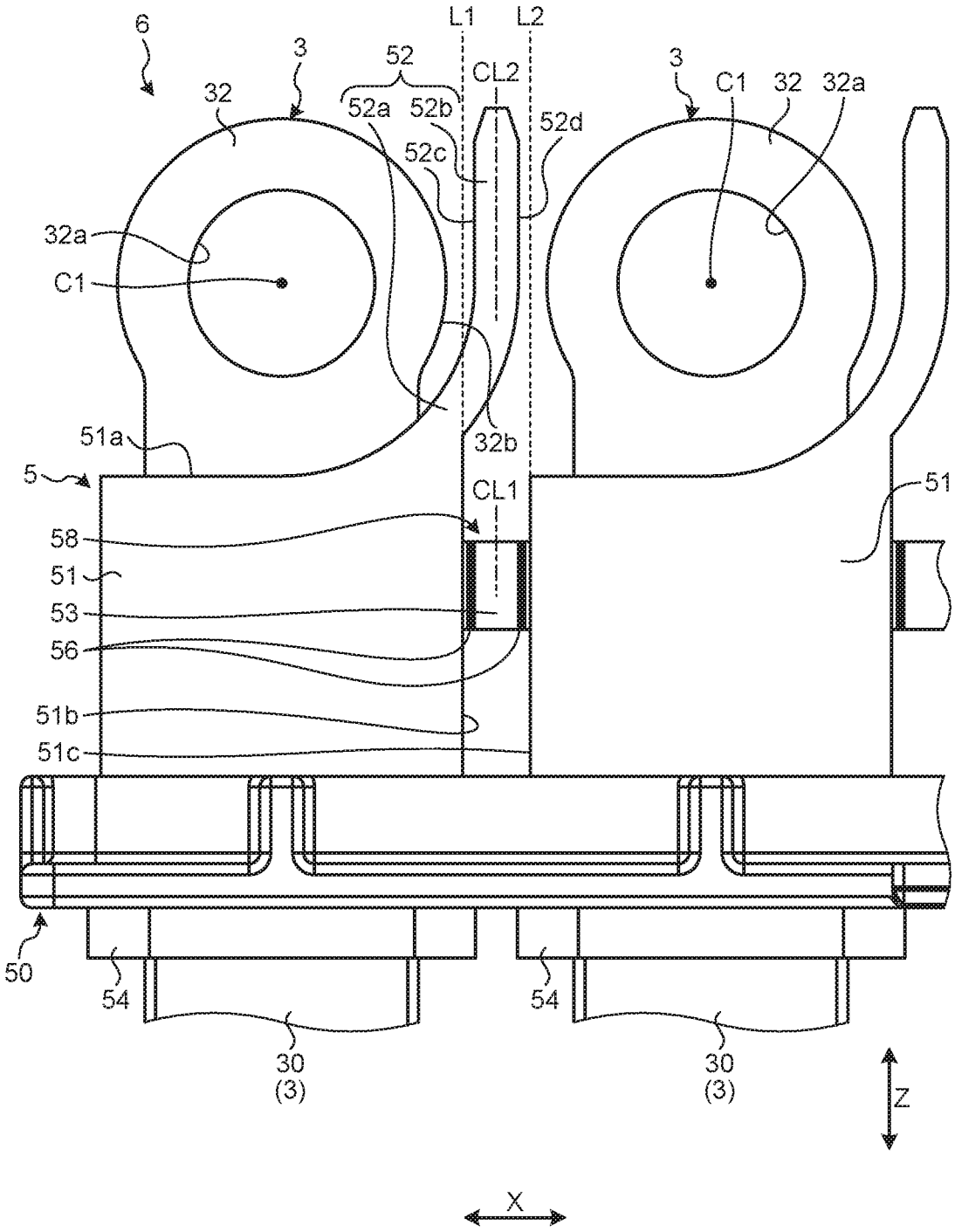
FIG. 17 is an enlarged view of the conductor unit according to the embodiment.
Figure 18:
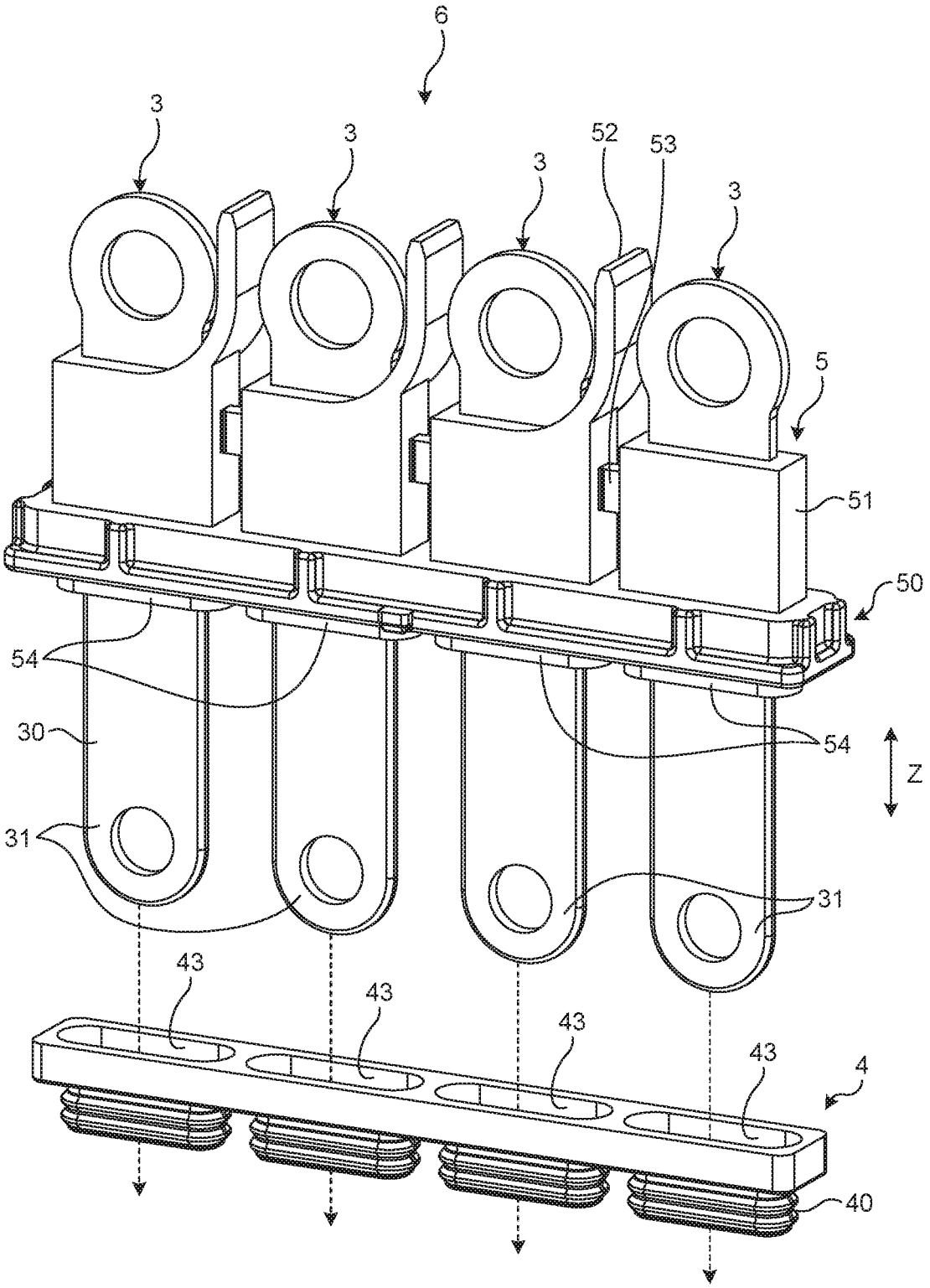
FIG. 18 is a perspective view illustrating attachment of the sealing member with respect to the conductor unit.
Figure 19:
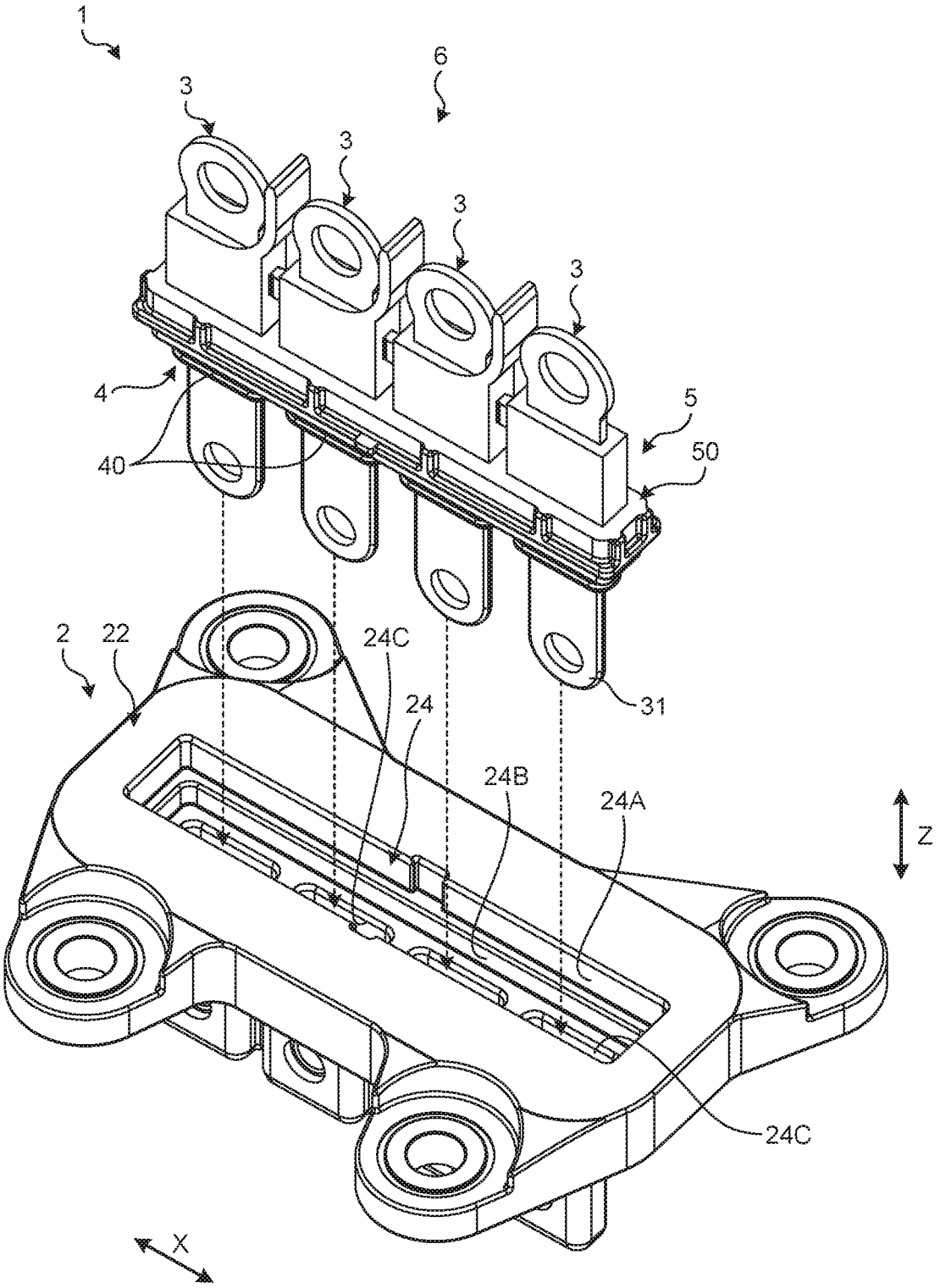
FIG. 19 is a perspective view for explaining assembly of the conductor unit with respect to the housing.
Figure 20:
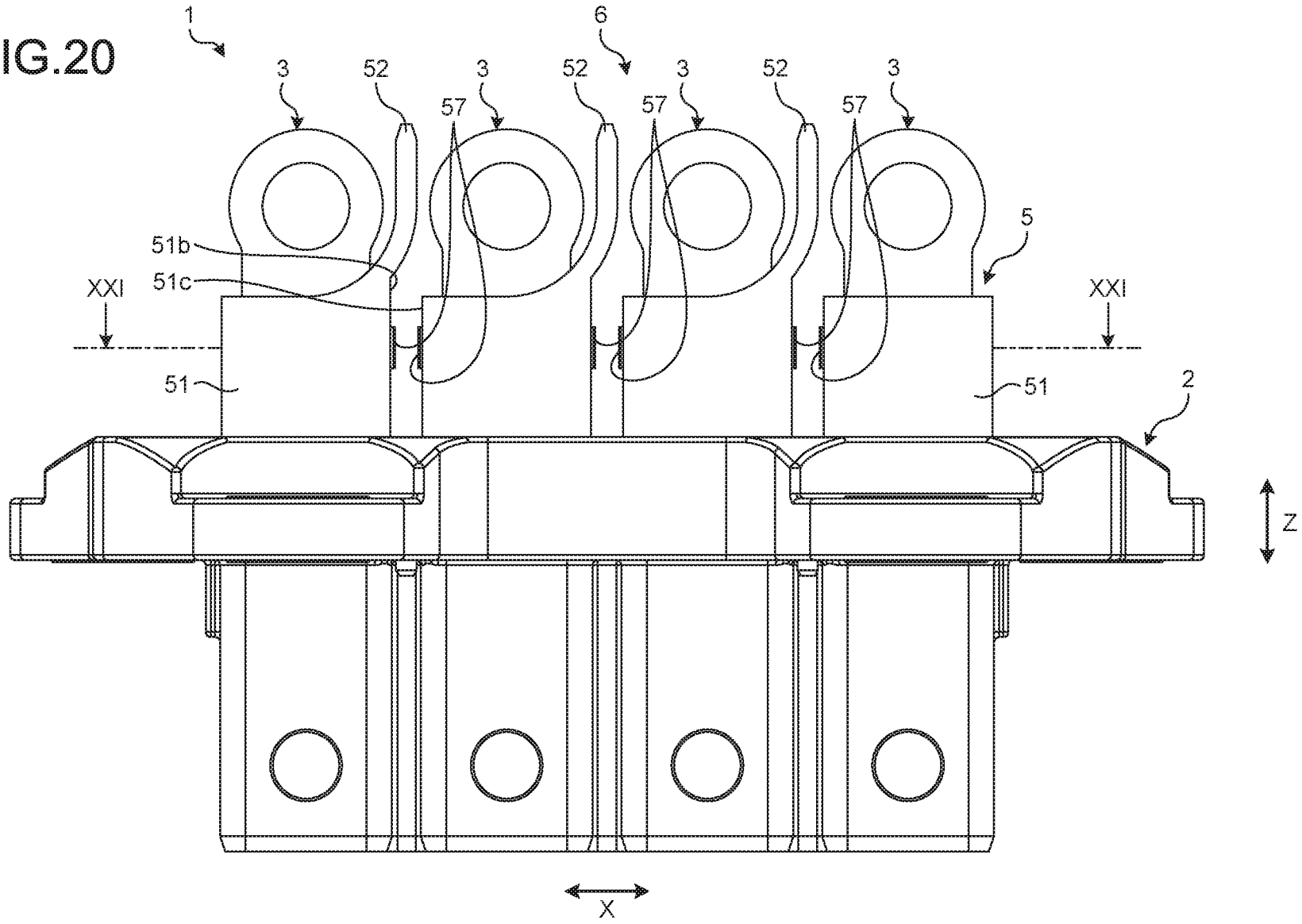
FIG. 20 is a front view illustrating the connector after connecting parts are cut.
Figure 21:
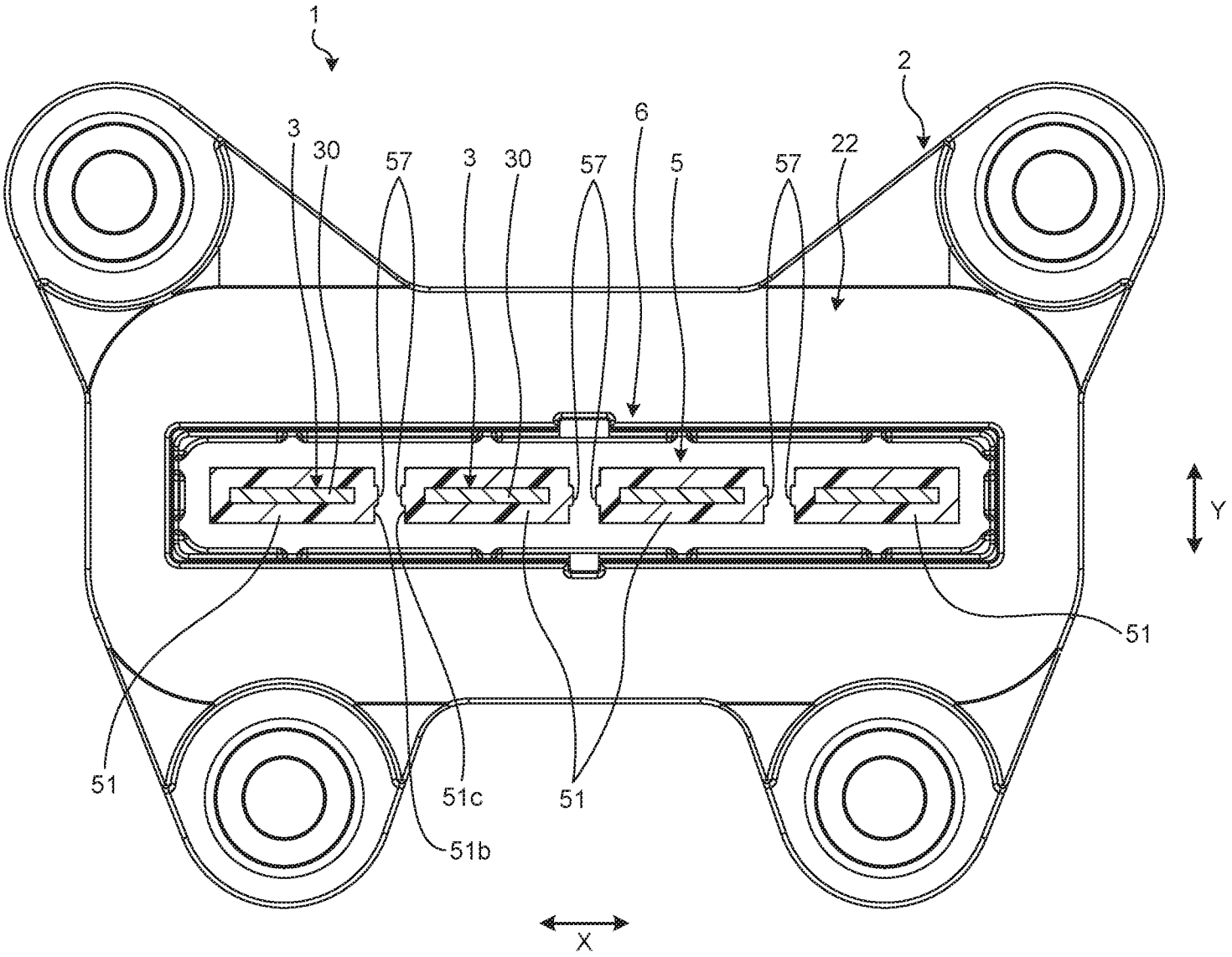
FIG. 21 is a sectional view illustrating the connector after the connecting parts are cut.
Figure 22:
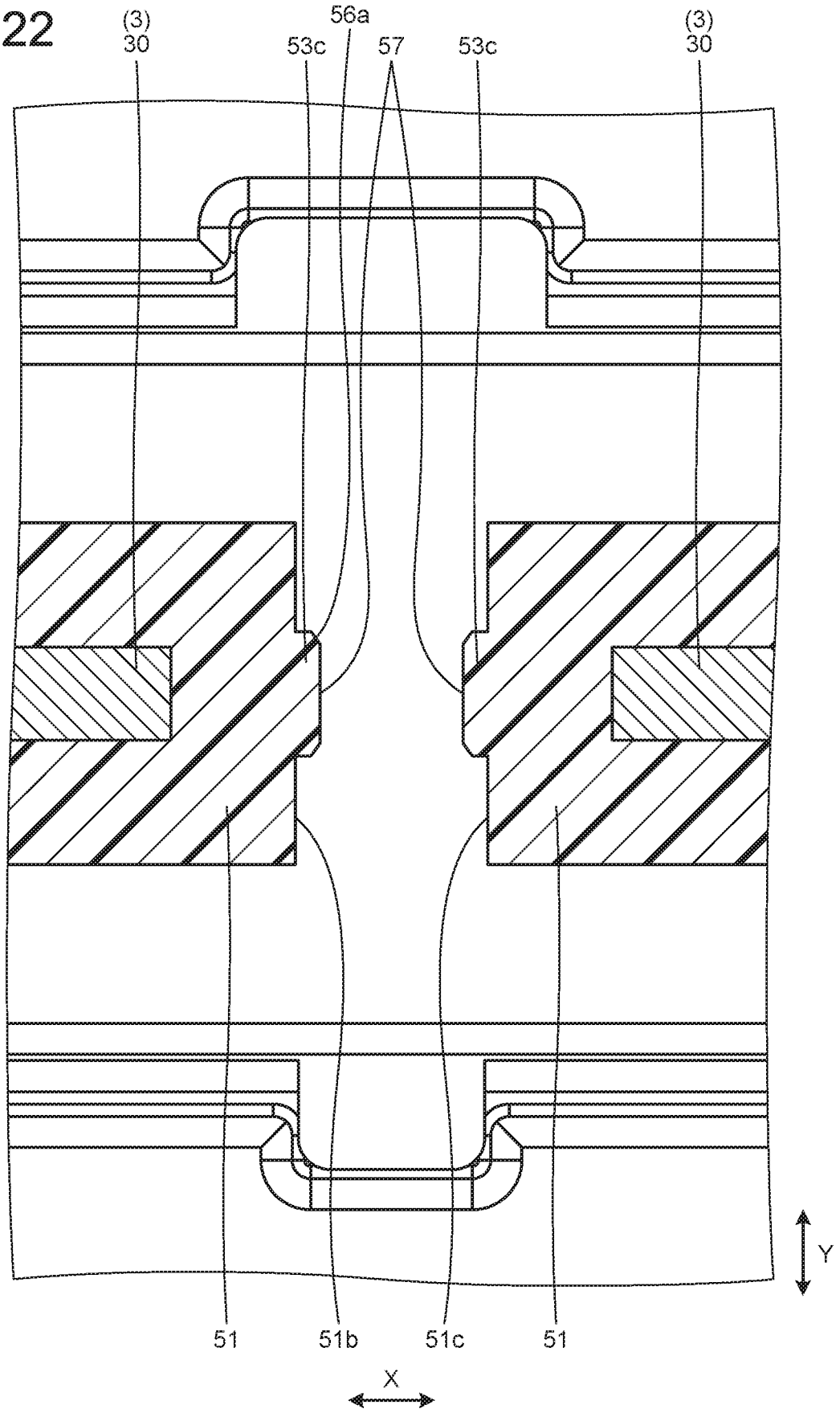
FIG. 22 is an enlarged sectional view illustrating the connector after the connecting parts are cut.
Figure 23:
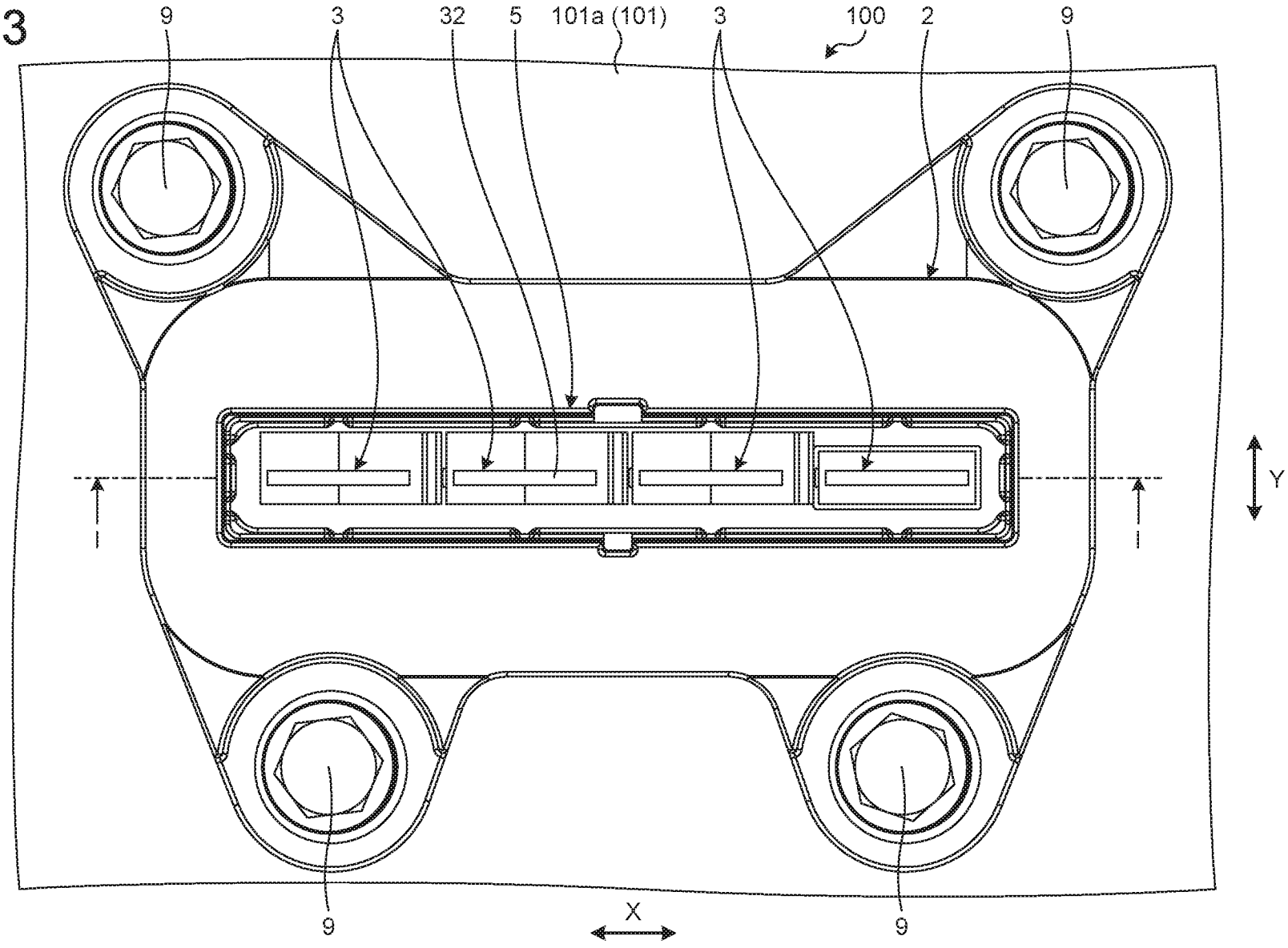
FIG. 23 is a plan view illustrating the connector attached to the first device.

FIG. 12 is a front view of a conductor unit according to the embodiment, FIG. 13 is a side view of the conductor unit according to the embodiment, FIG. 14 is a top view of the conductor unit according to the embodiment, FIG. 15 is a bottom view of the conductor unit according to the embodiment, FIG. 16 is a sectional views of the conductor unit according to the embodiment, FIG. 17 is an enlarged view of the conductor unit according to the embodiment, FIG. 18 is a perspective view illustrating attachment of the sealing member with respect to the conductor unit, FIG. 19 is a perspective view for explaining assembly of the conductor unit with respect to the housing, FIG. 20 is a front view illustrating the connector after connecting parts are cut, FIG. 21 is a sectional view illustrating the connector after the connecting parts are cut, FIG. 22 is an enlarged sectional view illustrating the connector after the connecting parts are cut, and FIG. 23 is a plan view illustrating the connector attached to the first device.

FIG. 1 illustrates a section taken along line I-I of FIG. 23. FIG. 6 illustrates a section taken along line VI-VI of FIG. 3. FIG. 7 illustrates a section taken along line VII-VII of FIG. 4. FIG. 10 illustrates a section taken along line X-X of FIG. 9. FIG. 11 illustrates a section taken along line XI-XI of FIG. 8. FIG. 16 illustrates a section taken along line XVI-XVI of FIG. 12. FIG. 21 illustrates a section taken along line XXI-XXI of FIG. 20.

Figure 2:
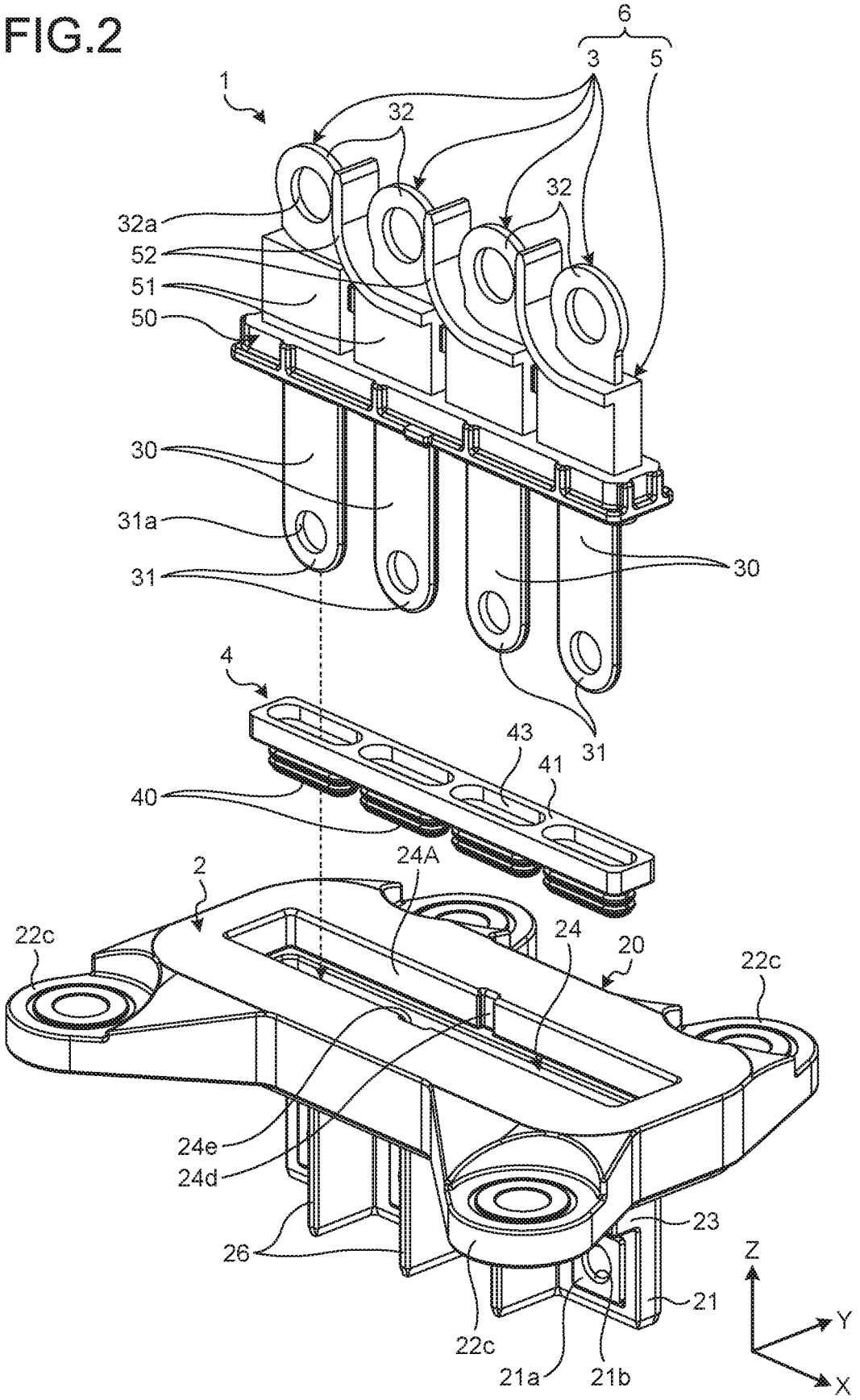
FIG. 2 is an exploded perspective view of the connector according to the embodiment.

As illustrated in FIG. 1 and FIG. 2, a connector 1 according to the embodiment has a housing 2, a conductor unit 6, and a sealing member 4. The connector 1 electrically connects a first device 100 and a second device 200. In the present embodiment, the first device 100 is a motor and the second device 200 is an inverter. The first device 100 and the second device 200 are mounted on a vehicle such as an automobile, for example. A motor body 103 of the first device 100 and an inverter body 203 of the second device 200 are electrically connected via a plurality of conductors 3.

The second device 200 is interposed between a battery mounted on the vehicle and the first device 100. The second device 200 has a conversion function between a direct current and an alternating current and a transformation function of stepping up and down a voltage. The supply of electric power from the battery to the first device 100 is controlled by the second device 200. Furthermore, electric power generated by regeneration in the first device 100 is stored in the battery via the second device 200.

The first device 100 has a casing 101 and the motor body 103. The motor body 103 is a main component of the first device 100 and includes a rotor and a stator. The motor body 103 is disposed in an internal space 102 of the casing 101. In the internal space 102 of the casing 101, a first liquid 104 is stored. The first liquid 104 is a liquid having a lubricating function and a cooling function for the motor body 103, and is, for example, oil. An upper wall part 101*a* of the casing 101 has an opening 101*b*. The opening 101*b* penetrates the wall part 101*a* and allows the internal space 102 of the casing 101 and an external space of the casing 101 to communicate with each other.

The second device 200 has a casing 201 and the inverter body 203. The inverter body 203 is a main component of the second device 200 and includes a switching circuit. The inverter body 203 is disposed in an internal space 202 of the casing 201. A pipe 204 is provided in the internal space 202 of the casing 201. A second liquid 205 for cooling is supplied to the inverter body 203 via the pipe 204. The second liquid 205 is, for example, coolant. A lower wall part 201*a* of the casing 201 has an opening 201*b*.

The casing 101 and the casing 201 are fixed to each other with the opening 101*b* and the opening 201*b* facing each other. A gasket 300 is interposed between the wall part 101*a* of the casing 101 and the wall part 201*a* of the casing 201.

The connector 1 is fixed to the casing 101 of the first device 100 at a communication part 10 through which the opening 101*b* of the first device 100 and the opening 201*b* of the second device 200 communicate with each other. The communication part 10 is a part where the opening 101*b* of the first device 100 and the opening 201*b* of the second device 200 face each other. In the present embodiment, the opening 201*b* of the second device 200 is larger than the opening 101*b* of the first device 100. Accordingly, the wall part 101*a* of the casing 101 is exposed toward the internal space 202 of the second device 200.

As illustrated in FIG. 1 and FIG. 2, the conductor unit 6 of the present embodiment has the conductors 3 and an insulating holding body 5. The illustrated conductor 3 is a bus bar and is made of a conductive metal, for example, copper, aluminum, and the like. The conductor 3 is formed, for example, by being punched out from a metal plate as a base material. The number of the conductors 3 included in the conductor unit 6 of the present embodiment is four. However, the number of the conductors 3 is not limited to four. The conductor 3 has a body 30, a first terminal part 31, and a second terminal part 32. The body 30 has a rectangular plate shape.

The first terminal part 31 is connected to one end of the body 30 in a longitudinal direction. The first terminal part 31 is electrically connected to a terminal included in the first device 100. The first terminal part 31 has a circular shape, for example. The outer diameter of the first terminal part 31 is equal to the width of the body 30. The first terminal part 31 has a through-hole 31*a* into which a fastening member is inserted. The second terminal part 32 is connected to the other end of the body 30 in the longitudinal direction. The second terminal part 32 is electrically connected to a terminal included in the second device 200. The second terminal part 32 has a circular shape, for example. The second terminal part 32 has a through-hole 32*a* into which a fastening member is inserted. The outer diameter of the second terminal part 32 is larger than that of the first terminal part 31. Furthermore, the outer diameter of the second terminal part 32 is larger than the width of the body 30.

The conductors 3 are arranged in a row. More specifically, the conductors 3 are arranged on the same plane along the width direction of the body 30. In the present embodiment, the longitudinal direction of the conductor 3 is referred to as a "height direction Z". Furthermore, a direction in which the conductors 3 are arranged is referred to as a "first direction X". The first direction X is orthogonal to the height direction Z. A direction orthogonal to both the first direction X and the height direction Z is referred to as a "second direction Y". The second direction Y is a plate thickness direction of the conductor 3. The conductors 3 are arranged, for example, such that the first terminal part 31 is arranged on a straight line and the second terminal part 32 is arranged on a straight line.

The holding body 5 is integrally molded with the conductors 3. The holding body 5 is, for example, an insulating synthetic resin and is integrally formed with the conductors 3 by insert molding. The holding body 5 has a fitting part 50 fitted to the housing 2, a plurality of covering parts 51, and a plurality of insulating walls 52. A detailed structure of the holding body 5 will be described below.

As illustrated in FIG. 2, the housing 2 has a body 20 and a wall part 21. The body 20 and the wall part 21 are integrally molded by an insulating synthetic resin, for example. The material of the housing 2 is resistant to the first liquid 104. The material of the housing 2 is, for example, an oil-resistant synthetic resin. The body 20 is a part fixed to the wall part 101*a* of the first device 100. The body 20 has a base 22 formed in a plate shape and a protruding part 23 protruding toward the height direction Z from the base 22. The wall part 21 protrudes toward the height direction Z from a tip end of the protruding part 23.

As illustrated in FIG. 3, the base 22 has a substantially planar rectangular shape. The longitudinal direction of the base 22 is the first direction X. The base 22 is provided at the four corners thereof with fixed parts 22*c* each having a through-hole. The fixed parts 22*c* are fixed to the wall part 101*a* of the first device 100 by, for example, bolts 9 (see FIG. 23). As illustrated in FIG. 5 and the like, the base 22 has a first surface 22*a* and a second surface 22*b*. The second surface 22*b* is a surface on which the protruding part 23 is provided. The first surface 22*a* is a surface opposite to the second surface 22*b*. The base 22 is fixed with the first surface 22*a* facing the second device 200 and with the second surface 22*b* facing the wall part 101*a*. The first surface 22*a* faces upward when the first device 100 and the second device 200 are installed in a vehicle, for example.

As illustrated in FIG. 4 and FIG. 5, the protruding part 23 protrudes toward the height direction Z from the second surface 22*b* of the base 22. The protruding part 23 has a substantially rectangular parallelepiped shape. The protruding part 23 in a section orthogonal to the height direction Z has a substantially sectional rectangular shape. In the sectional shape of the protruding part 23, the longitudinal direction is the first direction X.

As illustrated in FIG. 2 and FIG. 3, the body 20 has a recess 24 formed in multiple stages. The recess 24 is opened to the first surface 22*a* of the base 22 and is recessed toward the wall part 21 along the height direction Z. The recess 24 has a first recess 24A, a second recess 24B, and third recesses 245. The first recess 24A is fitted to the holding body 5 and supports the holding body 5 from below. The second recess 24B and the third recesses 245 are fitted to the sealing member 4 and supports the sealing member 4 from below.

As illustrated in FIG. 3, the first recess 24A has a substantially planar rectangular shape. The longitudinal direction of the first recess 24A is the first direction K. The first recess 24A has a first wall surface 24*f* and a second wall surface 24*g* facing each other in the second direction Y. The first wall surface 24*f* and the second wall surface 24*g* are surfaces along the first direction K and the height direction Z.

The first recess 24A has a first groove 24*d* and a second groove 24*e*. The first groove 24*d* and the second groove 24*e* restrict the direction when the holding body 5 is attached to the housing 2, and prevent erroneous assembly. The first groove 24*d* and the second groove 24*e* extend along the height direction Z. The first groove 24*d* is Provided on the first wall surface 24*f*. The second groove 24*e* is provided on the second wall surface 24*g*. The first groove 24*d* and the second groove 24*e* face each other in the second direction Y. The groove width of the first groove 24*d* is smaller than that of the second groove 24*e*.

The second recess 24B is recessed along the height direction Z from a bottom surface 24*h* of the first recess 24A toward the wall part 21 side. The second recess 24B has a substantially planar rectangular shape. The longitudinal direction of the second recess 24B is the first direction X. The third recesses 24C are recessed along the height direction Z from a bottom surface 24*j* of the second recess 24B toward the wall part 21 side. The recess 24 of the present embodiment has a plurality of third recesses 24C. The number of the third recesses 24C is set to four in accordance with the number of the conductors 3. The four third recesses 24C are arranged in a row along the first direction X. The four third recesses 24C are disposed at equal intervals, for example. Each of the third recesses 24C has a substantially planar rectangular shape. The longitudinal direction of the third recess 24C is the first direction X.

As illustrated in FIG. 3, the body 20 has a plurality of first through-holes 25. The conductors 3 are press-fitted into the first through-holes 25, respectively, and held by the first through-holes 25. Each of the first through-holes 25 has a sectional shape corresponding to that of the conductor 3, and has a rectangular shape, for example. The longitudinal direction in the sectional shape of the first through-hole 25 is the first direction X. The number of the first through-holes 25 included in the body 20 is four in accordance with the number of the conductors 3 to be inserted. The first through-holes 25 are disposed at equal intervals along the first direction X.

As illustrated in FIG. 6 and the like, the first through-holes 25 penetrate the body 20 along the height direction Z. One end of the first through-hole 25 is opened to a bottom surface 24*k* of the third recess 24C. The other end of the first through-hole 25 is opened to a tip end surface 23*a* of the protruding part 23. One first through-hole 25 is disposed for one third recess 24C. Note that the recess 24 and the first through-holes 25 may be combined and regarded as a continuous through-hole. In such a case, the through hole is understood as a multi-step through-hole whose sectional area gradually decreases from the first surface 22*a* of the base 22 to the tip end surface 23*a* of the protruding part 23.

The wall part 21 is a rectangular flat plate-shaped component part and protrudes toward the height direction Z from the tip end surface 23*a* of the protruding part 23. As illustrated in FIG. 4, FIG. 7, and the like, the wall part 21 holds nuts 21*a*. Four nuts 21*a* are fixed to the wall part 21 of the present embodiment in correspondence with the four conductors 3. The nuts 21*a* are integrally formed with the wall part 21 by molding, for example. A screw hole 21*b* of each of the nuts 21*a* extends along the second direction Y. The first terminal part 31 of the conductor 3 and a terminal 105 of the first device 100 are co-fastened to the nut 21*a* by a bolt.

The housing 2 has a plurality of insulating walls 26. Each of the insulating walls 26 is a wall that divides between the adjacent conductors 3. The housing 2 of the present embodiment has three insulating walls 26 in correspondence with the four conductors 3. The insulating walls 26 protrude toward the second direction Y from the side surface of the protruding part 23 and the wall part 21. The insulating walls 26 extend along the height direction Z from the second surface 22*b* of the base 22 to a tip end surface 21*c* of the wall part 21.

As illustrated from FIG. 8 to FIG. 11, the sealing member 4 has a plurality of sealing parts 40 and a connecting part 41. The sealing member 4 is an insulating member having a mat seal shape in which a plurality of O-rings are connected in series. The sealing member 4 of the present embodiment has four sealing parts 40 in correspondence with the four conductors 3. The four sealing parts 40 are disposed in a row along the first direction X. The four sealing parts 40 are disposed at equal intervals, for example. The sealing parts 40 and the connecting part 41 are integrally molded by a resin such as rubber. The material of the sealing member 4 is a material having resistance to the first liquid 104, and is, for example, oil-resistant acrylic rubber and the like.

The sealing parts 40 seal between the conductors 3 and the housing 2. The shape of each of the sealing parts 40 is annular, for example, tubular. The sectional shape of the sealing part 40 of the present embodiment is elliptical or rectangular. The longitudinal direction of the sealing part 40 is the first direction X. The sealing part 40 is a shaft seal whose inner peripheral surface is in close contact with the conductor 3 and whose outer peripheral surface is in close contact with the housing 2. The sealing part 40 is provided on the outer peripheral surface thereof with an annular lip 42.

As illustrated in FIG. 8 and the like, the connecting part 41 has a flat plate shape. The connecting part 41 has a first surface 41*a* and a second surface 41*b*. The first surface 41*a* is a surface facing the second device 200. The first surface 41*a* faces upward when the first device 100 and the second device 200 are installed in a vehicle, for example. The second surface 41*b* is a surface opposite to the first surface 41*a*. The second surface 41*b* faces downward when the first device 100 and the second device 200 are installed in a vehicle, for example. The sealing parts 40 protrude toward the height direction Z from the second surface 41*b*.

As illustrated in FIG. 2 and FIG. 10, the connecting part 41 has recesses 43. Protrusions 54 of the holding body 5 to be described below are inserted into the recesses 43, respectively. The connecting part 41 of the present, embodiment has four recesses 43 in correspondence with the four conductors 3. The four recesses 43 are arranged in a row along the first direction X. The four recesses 43 are disposed at equal intervals, for example. The recesses 43 are recessed along the height direction Z from the first surface 41*a* toward the second surface 41*b*. That is, the recesses 13 are opened toward the height direction Z on the first surface 41*a*. In the plan view, each of the recesses 43 has a substantially elliptical shape. The longitudinal direction of the recess 13 is the first direction X.

As illustrated in FIG. 10 and the like, the sealing member 4 has a plurality of through-holes 44 into which the conductors 3 are inserted, respectively. Each of the through-holes 44 has a substantially sectional rectangular shape. The longitudinal direction in the sectional shape of the through-hole 44 is the first direction X. The sealing member 4 has four through-holes 44 in correspondence with the four conductors 3. The four through-holes 44 are disposed at equal intervals, for example. The through-holes 44 penetrate the connecting part 41 and the sealing parts 40 along the height direction Z. One end of the through-hole 44 is opened to a bottom surface 43*a* of the recess 43. The other end of the through-hole 44 is opened to a tip end surface 40*a* of the sealing part 40. One through-hole 44 is disposed for one sealing part 40. Note that the recess 43 and the through-holes 44 may be combined and regarded as one continuous through-hole. In such a case, the through-hole is understood as a through-hole that penetrates from the first surface 41*a* of the connecting part 41 to the tip end surface 40*a* of the sealing part 40 and has a smaller sectional area on the tip end surface 40*a* side than the bottom surface 43*a*.

As illustrated from FIG. 12 to FIG. 15, the holding body 5 has the fitting part 50, the covering parts 51, the insulating walls 52, connecting parts 53, and the protrusions 54. The fitting part 50, the covering parts 51, the insulating walls 52, the connecting parts 53, and the protrusions 54 are integrally molded with one another. The fitting part 50 has a rectangular plate shape or a rectangular parallelepiped shape. The fitting part 50 is fitted into the first recess 24A of the housing 2 and supported by the first recess 24A. The fitting part 50 is integrally formed with the bodies 30 of the conductors 3 and connects the four conductors 3. The fitting part 50 is located at intermediate parts of the bodies 30 in the height direction Z.

As illustrated in FIG. 13 and the like, the fitting part 50 has a first side surface 50*c* and a second side surface 50*d*. The first side surface 50*c* and the second side surface 50*d* are side surfaces facing the second direction Y. The fitting part 50 has a first rib 50*a* and a second rib 50*b*. The first rib 50*a* protrudes toward the second direction Y from a central part of the first side surface 50*c* of the fitting part 50. The second rib 50*b* protrudes toward the second direction Y from a central part of the second side surface 50*d* of the fitting part 50. The first rib 50*a* is guided by the first groove 24*d* of the housing 2. The second rib 50*b* is guided by the second groove 24*e* of the housing 2. In the first direction X, the width of the first rib 50*a* is smaller than that of the second rib 50*b*.

Each of the covering parts 51 individually surrounds the body 30 of the conductor 3. That is, the holding body 5 has one covering part 51 for one body 30. The covering part 51 extends from the fitting part 50 along the body 30. More specifically, the covering part 51 extends from the fitting part 50 toward the second terminal part 32 of the conductor 3 along the height direction Z. Between adjacent covering parts 51, a slit-shaped gap is provided. A tip end surface 51*a* of the covering part 51 is located slightly closer to the fitting part 50 side than the second terminal part 32. That is, an end part of the body 30 on the second terminal part 32 side protrudes from the covering part 51. Each of the covering parts 51 is integrally formed with a corresponding body 30. The covering part 51 of the present embodiment has a substantially sectional rectangular shape.

The covering part 51 has a first surface 51*b* and a second surface 51*c*. The first surface 51*b* is one of the two side surfaces facing the first direction X. The first surface 51*b* is located on a side where the insulating wall 52 is provided. The second surface 51*c* is the other of the two side surfaces facing the first direction X. The second surface 51*c* is located on a side opposite to the side where the insulating wall 52 is provided. Two adjacent covering parts 51 are disposed such that the first surface 51*b* of one covering part 51 and the second surface 51*c* of the other covering part 51 face each other.

The insulating wall 52 is a wall part, that divides two adjacent second terminal parts 32. The insulating wall 52 is provided at the tip end of the covering part 51. The insulating wall 52 has a base 52*a* and a main wall part 52*b*. The base 52*a* and the main wall part 52*b* are formed in one continuous plate shape. The base 52*a* is connected to an end part at the tip end of the covering part 51 on the first surface 51*b* side. The base 52*a* is connected to the tip end surface 51*a* of the covering part 51, and is continuous with the tip end surface 51*a*. The base 52*a* extends toward a direction away from the tip end of the covering part 51 along the first direction X and the height direction Z. In other words, the base 52*a* projects from one covering part 51 toward another adjacent covering part 51.

As illustrated in FIG. 12, the shape of the base 52*a* when viewed directly from the second direction. Y is a curved shape. The base 52*a* is curved such that a gap with an outer peripheral surface 32*b* of the second terminal part 32 is substantially constant. That is, the base 52*a* is curved toward a direction away from the second terminal part 32. The shape of the base 52*a* is, for example, an arc shape concentric with the center of the second terminal part 32.

The main wall part 52*b* of the present embodiment is formed in a flat plate shape. As illustrated in FIG. 17, a gap 58 is provided between two adjacent covering parts 51. When viewed directly from the second direction Y, the main wall part 52*b* extends on an extension line of the gap 58. The main wall part 52*b* of the present embodiment extends in a space between an extension line L1 of the first surface 51*b* of the covering part 51 and an extension line 12 of the second surface 51*c* of the covering part 51. That is, one surface 52*c* of the main wall part 52*b* is located closer to the extension line L1 side than the extension line 12. On the other hand, an other surface 52*d* of the main wall part 52*b* is located closer to the extension line 12 side than the extension line L1. Furthermore, in the present embodiment, a center line CL2 of the main wall part 52*b* is on an extension line of a center line CL1 of the gap 58.

Furthermore, the main wall part 52*b* is located in the middle between two adjacent second terminal parts 32 in the first direction X. For example, the main wall part 52*b* is formed to be equidistant from the two adjacent second terminal parts 32. The center line CL2 of the main wall part 52*b* may be equidistant from a center C1 of each of the two adjacent second terminal parts 32.

The main wall part 52*b* is connected to the tip end of the base 52*a*. In other words, the main wall part 52*b* is connected to the covering part 51 via the base 52*a*. The main wall part 52*b* extends toward a direction away from the covering part 51 along the height direction Z. In other words, the main wall part 52*b* extends from the tip end of the base 52*a* along an extension direction of the covering part 51. As illustrated in FIG. 17, the shape of the main wall part 52*b* when viewed directly from the second direction Y is a linear shape.

The holding body 5 of the present embodiment has three insulating walls 52. Among the four covering parts 51 arranged in the first direction X, one covering part 51 at one end is provided with no insulating wall 52 and the remaining three covering parts 51 are provided with the insulating walls 52, respectively. As illustrated in FIG. 13 and FIG. 14, a width Wd1 of the insulating wall 52 along the second direction Y is larger than a thickness t1 of the covering part 51.

In the present embodiment, the main wall part 52*b* extends on the extension line of the gap 58, so that the connector 1 is miniaturized. As a comparative example, a configuration is assumed in which in the holding body 5 the insulating wall 52 is linearly extended from the tip end surface 51*a* of the covering part 51 along the height direction Z. In the configuration of the comparative example, when the insulating wall 52 is provided so as not to interfere with the second terminal part 32, it is necessary to increase the width of the covering part 51. As a consequence, the width of the holding body 5 is increased, which leads to an increase in the size of the connector 1.

On the other hand, in the connector 1 of the present embodiment, the main wall part 52*b* is disposed on the extension line of the gap 58. Thus, it is possible to form the insulating wall 52 while the width of the covering part 51 is set to the necessary minimum size. Furthermore, by disposing the main wall part 52*b* on the extension line of the gap 58, it is possible to avoid interference between the insulating wall 52 and the second terminal part 32.

As illustrated in FIG. 13 and the like, the protrusion 54 protrudes toward the height direction Z from a lower surface 50*e* of the fitting part 50. The protrusion 54 is integrally formed with the body 30 so as to surround the body 30 of the conductor 3. The protrusion 54 serves as an O-ring stopper that supports the sealing part 40. One protrusion 54 is formed for one conductor 3. As illustrated from FIG. 15, in the plan view, the protrusion 54 has an elliptical shape. The shape of the protrusion 54 corresponds to the shape of the recess 43 of the sealing member 4 and the shape of the sealing part 40.

As illustrated in FIG. 12, the connecting part 53 connects adjacent covering parts 51. More specifically, the connecting part 53 connects the first surface 51*b* of one covering part 51 and the second surface 51*c* of the adjacent covering part 51. The connecting part 53 has a flat plate shape. In the front view, the connecting part 53 has a rectangular shape. A height Ht1 of the connecting part 53 is a larger than a width Wd2 of the connecting part 53. The height Ht1 of the connecting part 53 is a dimension of the connecting part 53 along the height direction Z and the width Wd2 of the connecting part 53 is a dimension of the connecting part 53 along the first direction X.

The connecting part 53 is disposed at a position apart from the fitting part 50 in the extension direction of the covering part 51. The connecting part 53 may be provided at a position near the tip end surface 51*a*. The connecting part 53 is disposed, for example, on the tip end surface 51*a* side with respect to a middle point of the covering part 51 in the height direction Z.

As illustrated in FIG. 16, the connecting part 53 is located on a line connecting two adjacent bodies 30. That is, the bodies 30 and the connecting parts 3 are located on the same line. A thickness t2 of the connecting part 53 is smaller than a thickness t1 of the covering part 51. Due to the difference between the thicknesses of the connecting part 53 the covering part 51, a recess 55 is formed. The recess 55 is formed by the first surface 51*b*, the second surface 51*c*, and the connecting part 53. The recess 55 is formed on both sides of the connecting part 53 in the second direction Y.

In the connector 1 of the present embodiment, the holding body 5 is provided with the connecting part 53, so that the moldability of the holding body 5 is improved. For example, even though a force for relatively moving adjacent covering parts 51 is generated during cooling after molding, the relative movement is restricted by the connecting part 53. That is, the connecting part 53 can restrict the deformation of the holding body 5 during the cooling. Furthermore, the connecting part 53 can restrict the deformation of the holding body 5 during transportation or in an assembly process. Moreover, in a mold for molding the holding body 5, spaces corresponding to the covering parts 51 are communicated with each other by a space corresponding to the connecting part 53. Thus, the fluidity of a resin during molding is improved.

Details of the connecting part 53 of the embodiment will be described. As illustrated in FIG. 12 and FIG. 16, the connecting part 53 has grooves 56. The grooves 56 extend along the height direction Z. In other words, the grooves 56 extend along the covering parts 51. The grooves 56 of the present embodiment are formed from one end to the other end of the connecting part 53 along the height direction Z. The grooves 56 are provided on both sides of the connecting part 53.

The connecting part 53 is provided on one side thereof with two grooves 56, One groove 56 is disposed at each of one end part and the other part in the first direction X. That is, one of the two grooves 56 is located in the vicinity of the first surface 51*b* and extends along the first surface 51*b*. The other of the two grooves 56 is located in the vicinity of the second surface Sic and extends along the second surface 51*c*.

The sectional shape of the groove 56 is such that the width thereof in the first direction X becomes narrower toward the bottom of the groove 56. The sectional shape of the groove 56 is, for example, a triangle. The arrangement of the groove 56 on one surface 53*a* of the connecting part 53 and the arrangement of the groove 56 on an other surface 53*b* correspond to each other. The groove 56 formed on the one surface 53*a* and the groove 56 formed on the other surface 53*b* face each other in the second direction Y. By providing the grooves 56 as described above, the connecting part 53 is easily cut at the position of the groove 56.

Next, an example of the procedure for assembling the connector 1 will be described. As illustrated in FIG. 18, the sealing member 4 is attached to the conductor unit 6. The first terminal parts 31 of the conductors 3 are inserted into the through-holes 44 from she recesses 43 of the sealing member 4, respectively. The protrusions 54 of the holding body 5 are fitted into the recesses 43 of the sealing member 4, respectively.

Next, as illustrated in FIG. 19, the conductor unit 6 and the sealing member 4 are assembled to the housing 2. The conductor unit 6 and the sealing member 1 are inserted into the recess 24 of the housing 2 with the first terminal parts 31 as a head. The sealing parts 40 of the sealing member 4 are inserted into the third recesses 24C of the housing 2, respectively. The connecting part 41 of the sealing member 4 is inserted into the second recess 24B. The connecting part 41 is received in the second recess 24B of the housing 2 and supported by the bottom surface 24*j* of the second recess 24B. The fitting part 50 of the holding body 5 is inserted into the first recess 24A of the housing 2. The conductors 3 are press-fitted into the first through-holes 25 of the housing 2, respectively, so that the conductor unit 6 is held by the housing 2.

When the assembly of the conductor unit 6 and the sealing member 4 to the housing 2 is completed, the connecting parts 53 are cut. A cutting step of cutting the connecting parts 53 is performed using, for example, a cutting machine or a jig. In the cutting step, the connecting part 53 is separated from the covering part 51 and removed. With this, as illustrated in FIG. 20 and FIG. 21, cutting marks 57 are formed in the holding body 5. The cutting marks 57 are formed on the first surface 51*b* and the second surface 51*c*, respectively. In other words, the cutting mark 57 is formed in a part of the covering part 51 that faces another adjacent covering part 51. The cutting mark 57 formed on the first surface 51*b* and the cutting mark 57 formed on the second surface 51*c* face each other in the first direction X.

As illustrated in FIG. 22, the cutting mark 57 is a cut, surface formed on the covering part 51 or the connecting part 53, The cutting mark 57 is a surface formed by a force applied to cut the connecting part 53, and is, for example, a surface formed by shear failure. The cutting mark 57 illustrated in FIG. 22 is formed at a position where the groove 56 was formed. That is, the cutting mark 57 is formed so as to connect two grooves 56 facing each other. In the connector 1 of the present embodiment, when a force for cutting the connecting part 53 is applied, stress concentration occurs in the groove 56. That is, the connecting part 53 is easily cut at the groove 56. Accordingly, in the cutting step, a part between the groove 56 on the first surface 51*b* and the groove 56 on the second surface 51*c* is separated from the covering part 51.

By cutting the connecting part 53 in the groove 56, a part of the connecting part 53 remains in the covering part 51 as a remaining part 53*c*. The remaining part 53*c* may have an inclined surface 56*a* that is a part of the groove 56. The surface roughness of the cutting mark 57 is rougher than that of the inclined surface 56*a*.

By cutting the connecting parts 53, the flexibility of the conductor unit 6 is improved. For example, two adjacent conductors 3 more easily move relatively. With this, workability when the second terminal part 32 is fixed to the second device 200 is improved, or stability of an electric connection between the second terminal part 32 and the second device 200 is improved. Furthermore, by cutting the connecting parts 53, a creepage distance between two adjacent conductors 3 is increased as compared with a case before the connecting parts 53 are cut. The holding body 5 of the present embodiment is configured such that a desired creepage distance can be secured between two adjacent conductors 3 in the state in which the connecting parts 53 have been cut.

FIG. 23 illustrates the connector 1 attached to the casing 101 of the first device 100. The housing 2 of the connector 1 is fixed to the wall part 101*a* by the bolts 9. Between the housing 2 and the wall part 101*a*, for example, a face seal is interposed. The terminal of the first device 100 is connected to the first terminal part 31 of the conductor 3, and the terminal of the second device 200 is connected to the second terminal part 32 of the conductor 3.

As described above, the connector 1 of the present embodiment has the insulating housing 2, the conductor unit 6, and the sealing member 4. The housing 2 is fixed to the casing 101 of the first device 100 at the communication part 10 through which the opening 101*b* of the casing 101 of the first device 100 and the opening 201*b* of the casing 201 of the second device 200 communicate with each other. The conductor unit 6 has the conductors 3 disposed in a row and the insulating holding body 5 integrally molded with the conductors 3. The sealing member 4 seals between the conductor unit 6 and the housing 2.

Each of the conductors 3 has the plate-shaped body 30 and the terminal parts 31 and 32 provided at both ends of the body 30, respectively. The holding body 5 has the fitting part 50, the covering parts 51, and the insulating walls 52. The fitting part 50 is a part fitted to the housing 2. Each of the covering parts 51 extends from the fitting part 50 along the body 30 and individually surrounds the body 30. Each of the insulating walls 52 extends from the covering part 51 and divides two adjacent second terminal parts 32. The insulating wall 52 has the main wall part 52*b*. The main wall part 52*b* extends on the extension line of the gap 58 between two adjacent covering parts 51, and divides two adjacent second terminal parts 32.

In the holding body 5 of the present embodiment, the main wall part 52*b* extends on the extension line of the gap 58. Thus, in the holding body 5, two adjacent second terminal parts 32 are divided by the insulating wall 52, so that an insulation distance is secured and an increase in size along the arrangement direction of the conductors 3 is suppressed. Accordingly, the connector 1 of the present embodiment can suppress an increase in size while securing an insulation distance between adjacent conductors 3.

The insulating wall 52 of the present embodiment has the base 52*a* that projects from one of two adjacent covering parts 51 toward the other covering part 51. The main wall part 52*b* extends from the tip end of the base 52*a* along the extension direction of the covering part 51. An insulation distance between adjacent conductors 3 is appropriately secured by the base 52*a* and the main wall part 52*b*.

Each of the conductors 3 of the present embodiment has the first terminal part 31 and the second terminal part 32. The first terminal parts 31 protrudes from the fitting part 50 and the second terminal part 32 protrudes from the covering part 51. The width of the second terminal part 32 is larger than that of the body 30 of the conductor 3. The main wall part 52*b* of the insulating wall 52 is located in the middle between two adjacent second terminal parts 32 in the arrangement of the conductor 3. According to the holding body 5 of the present embodiment, even though the width of the second terminal part 32 is larger than that of the body 30, it is possible to reduce the size of the connector 1 while suppressing interference between the insulating wall 52 and the second terminal part 32.

First Modification of Embodiment

Figure 24:
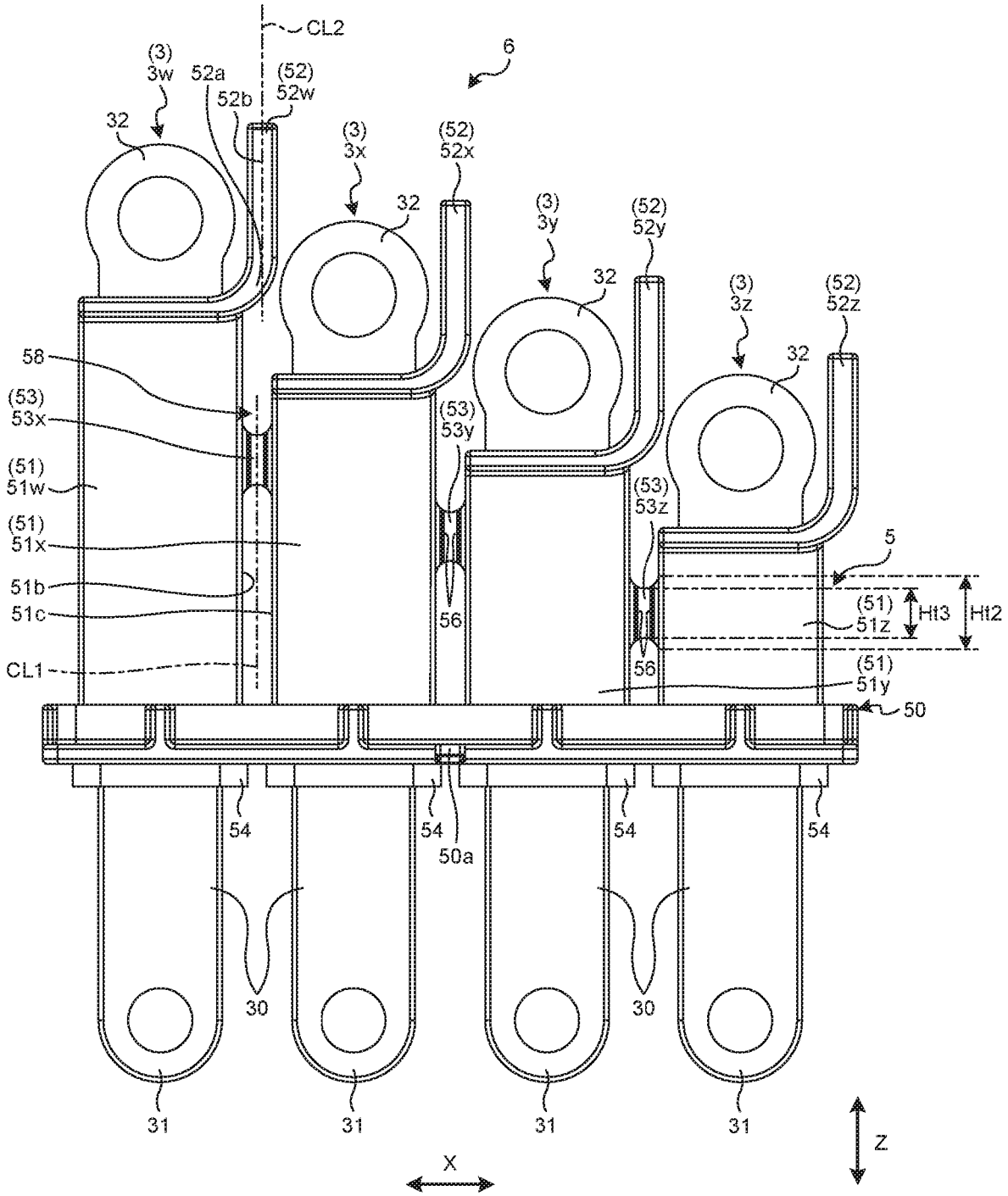
FIG. 24 is a front view illustrating a conductor unit according to a first modification of the embodiment.

A first modification of the embodiment will be described FIG. 24 is a front view illustrating a conductor unit according to the first modification of the embodiment. A conductor unit 6 according to the first modification of the embodiment is different from the conductor unit 6 of the aforementioned embodiment in that the conductor unit 6 includes conductors 3 having different lengths, for example.

As illustrated in FIG. 24, the conductor unit 6 according to the first modification has four conductors 3 and a holding body 5. All the four conductors 3 have different lengths. In the following description, the longest conductor 3 is referred to as a first conductor 3*w*. Furthermore, the second longest conductor 3 is referred to as a second conductor 3*x*, the third longest conductor 3 is referred to as a third conductor 3*y*, and the shortest conductor 3 is referred to as a fourth conductor 3*z*. The four conductors 3 are arranged in the order of length from a first conductor 3*w* to the fourth conductor 3*z*. Furthermore, the four conductors 3 are arranged such that all first terminal parts 31 are at the same position in the height direction Z. Accordingly, in relation to the protruding length protruding from a fitting part 50, the protruding length of the first conductor 3*w* is the longest and the protruding length of the fourth conductor 3*z* is the shortest.

The holding body 5 has the fitting part 50, covering parts 51, insulating walls 52, connecting parts 53, and protrusions 54. One covering part 51 is provided for each of the four conductors 3. In the following description, the covering part 51 surrounding the first conductor 3*w* is referred to as a first covering part 51*w*, the covering part 51 surrounding the second conductor 3*x* is referred to as a second covering part 51*x*, the covering part 51 surrounding the third conductor 3*y* is referred to as a third covering part 51*y*, and the covering part 51 surrounding the fourth conductor 3*z* is referred to as a fourth covering part 51*z*. Among the four covering parts 51*w* to 51*z*, the first covering part 51*w* is the longest and the fourth covering part 51*z* is the shortest.

As illustrated in FIG. 24, each of the connecting parts 53 has two grooves 56 on one surface thereof. That is, the connecting part 53 has four grooves 56, similarly to the connecting part 53 of the aforementioned embodiment. The groove 56 extends from the upper end to the lower end of the connecting part 53 along the height direction Z. In the shape of the connecting part 53 of the first modification, a height Ht2 of both end parts thereof in the first direction X is relatively large and a height Ht3 of a central part thereof is relatively small. That is, in the connecting part 53, strength of both end parts thereof is relatively high and strength of the central part thereof is relatively low. Accordingly, in the cutting step, the covering part 51 is less likely to be damaged.

As illustrated in FIG. 24, the holding body 5 has three connecting parts 53. In the following description, the connecting part 53 that connects the first covering part 51*w* and the second covering part 51*x* is referred to as a first connecting part 53*x*. Furthermore, the connecting part 53 that connects the second covering part 51*x* and the third covering part 51*y* is referred to as a second connecting part 53*y*. The connecting part 53 that connects the third covering part 51*y* and the fourth covering part 51*z* is referred to as a third connecting part 53*z*.

Among the three connecting parts 53*x* to 53*z*, the first connecting part 53*x* is located farthest from the fitting part 50 in the height direction Z. The third connecting part 53*z* is located closest to the fitting part 50 in the height direction Z. The second connecting part 53*y* is located at an intermediate position between the first connecting part 53*x* and the third connecting part 53*z* in the height direction Z. The three connecting parts 53*x* to 53*z* are disposed in this manner, so that the moldability of the holding body 5 is improved. For example, the first connecting part 53*x* is located near the tip end of the first covering part 51*w*, so that a resin is easily filled up to the tip end of the first covering part 51*w*.

The three connecting parts 53*x* to 53*z* may be cut and removed at any stage. The timing at which the three connecting parts 53*x* to 53*z* are cut is, for example, after the conductor unit 6 is assembled to the housing 2.

In the conductor unit 6 of the first modification, the insulating walls 52 are provided on ail the covering parts 51. Each of the insulating walls 52 has a base 52*a* and a main wall part 52*b*. In the following description, the insulating wall 52 provided on the first covering part 51*w* is referred to as a first insulating wall 52*w*. Furthermore, the insulating walls 52 provided on the second covering part 51*x*, the third covering part 51*y*, and the fourth covering part 51*z* are referred to as a second insulating wall 52*x*, a third insulating wall 52*y*, and a fourth insulating wall 52*z*, respectively. The first insulating wall 52*w* is located farthest from the fitting part 50 in the height direction Z. The fourth insulating wall 52*z* is located closest to the fitting part 50 in the height direction Z.

In the conductor unit 6 of the first modification, by shifting the positions of a plurality of second terminal parts 32 along the height direction Z, the width in the first direction X is reduced. Specifically, a center line CL2 of the main wall part 52*b* is at a position shifted from a center line CL1 of a gap 58. The first insulating wall 52*w* will be described as an example. The center line CL2 of the main wall part 52*b* is located closer to the second conductor 3*x* side than the center line CL1 of the gap 58. The position of the second terminal part 32 of the second conductor 3*x* and the position of the second terminal part 32 of the first conductor 3*w* are shifted from each other in the height direction Z, so that it is possible to reduce the width of the gap 58 while avoiding interference between the first insulating wall 52*w* and the second conductor 3*x*.

Second Modification of Embodiment

The shape and arrangement of the insulating walls 52 are not limited to the illustrated shape and arrangement. For example, the shape of the main wall part 52*b* is not limited to the flat plate shape. The main wall part 52*b* may be curved. It is sufficient that at least a part of the main wall cart 52*b* is located on the extension line of the gap 58. In other words, it is sufficient that at least, a part of the main wall part 52*b* is located in the space between the extension line L1 and the extension line L2.

The timing at which the connecting part 53 is cut is not limited to the illustrated timing. For example, the connecting part 53 may be cut after the holding body 5 is cooled and before the holding body 5 is assembled to the housing 2 or the sealing member 4. The shape and arrangement of the connecting parts 53 are not limited to the illustrated shape and arrangement.

The number and shape of the conductors 3 are not limited to the number and shape illustrated in the embodiment. The shapes of the housing 2, the sealing member 4, and the holding body 5 are appropriately designed according to the shape of the conductor 3. For example, in the holding body 5, the shape of the covering part 51 and the shape of the insulating wall 52 are designed according to the shape of the conductor 3. The shape of the sealing part 10 is not limited to the illustrated shape. Furthermore, the sealing part 40 is not limited to the shaft seal and may be a face seal. The first device 100 is not limited to the motor and the second device 200 is not limited to the inverter. Furthermore, the first liquid 104 is not limited to the oil and the second liquid 205 is not limited to the coolant.

The contents disclosed in the aforementioned embodiment and modifications can be combined and executed as appropriate.

In the connector according to the present embodiment, the insulating wall of the holding body has the main wall part. The main wall part extends on the extension line of the gap between two adjacent covering parts and divides two adjacent terminal parts. The main wall part is disposed on the extension line of the gap, so that an increase in the size of the holding body and the connector is suppressed. Thus, in accordance with the connector according to the present embodiment, there is an effect that it is possible to suppress an increase in the size of the connector while securing an insulation distance between adjacent conductors.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A connector comprising:

an insulating housing that is fixed to a casing of a first device at a communication part through which an opening of the casing of the first device and an opening of a casing of a second device communicate with each other;

a conductor unit including a plurality of conductors arranged in a row and an insulating holding body integrally molded with the conductors; and a sealing member that seals between the conductor unit and the housing, wherein each of the conductors includes a plate-shaped body and terminal parts provided at both ends of the body, respectively, the holding body includes a fitting part fitted to the housing, a plurality of covering parts each extending from the fitting part along the body and individually surrounding the body, and insulating walls each extending from the covering part and dividing the two adjacent terminal parts, and each of the insulating walls has a main wall part and the main wall part extends on an extension line of a gap between the two adjacent covering parts and divides the two adjacent terminal parts.

2. The connector according to claim 1, wherein the insulating wall includes a base that projects from one of the two adjacent covering parts toward the other covering part, and the main wall part extends from a tip end of the base along an extension direction of the covering part.

3. The connector according to claim 2, wherein the base is connected to a tip end surface of the covering part.

4. The connector according to claim 1, wherein the terminal parts of the conductor include a first terminal part that protrudes from the fitting part and a second terminal part, that protrudes from the covering part, a width of the second terminal part is larger than a width of the body, and the main wall part is located in a middle between the two adjacent second terminal parts in an arrangement direction of the conductors.

5. The connector according to claim 2, wherein the terminal parts of the conductor include a first terminal part that protrudes from the fitting part and a second terminal part that protrudes from the covering part, a width of the second terminal part is larger than a width of the body, and the main wall part is located in a middle between the two adjacent second terminal parts in an arrangement direction of the conductors.

6. The connector according to claim 3, wherein the terminal parts of the conductor include a first terminal part that protrudes from the fitting part and a second terminal part that protrudes from the covering part, a width of the second terminal part is larger than a width of the body, and the main wall part is located in a middle between the two adjacent second terminal parts in an arrangement direction of the conductors.

* * * * *